US006994224B2

(12) United States Patent
Barger et al.

(10) Patent No.: US 6,994,224 B2
(45) Date of Patent: Feb. 7, 2006

(54) MODEL RAILROAD COUPLER

(76) Inventors: J. Perry Barger, 4 Central Green, Winchester, MA (US) 01890; Arnold W. Johansen, Jr., 226 Stowe Rd., Marlborough, MA (US) 01752

( * ) Notice: Subject to any disclaimer, the term of this patent is extended or adjusted under 35 U.S.C. 154(b) by 0 days.

(21) Appl. No.: 10/753,759

(22) Filed: Jan. 8, 2004

(65) Prior Publication Data

US 2005/0167386 A1 Aug. 4, 2005

(51) Int. Cl.
*A63H 19/00* (2006.01)

(52) U.S. Cl. ..... 213/75 TC

(58) Field of Classification Search ..... 213/75 TC, 213/75 R, 100 R

See application file for complete search history.

(56) References Cited

U.S. PATENT DOCUMENTS

| | | | | |
|---|---|---|---|---|
| 2,213,286 | A | 9/1940 | Pettit | |
| 2,574,630 | A | 11/1951 | Edwards et al. | |
| 2,631,739 | A | 3/1953 | Bonanno | |
| 2,631,740 | A | 3/1953 | Watson | |
| 2,658,629 | A | 10/1953 | Pettit | |
| 3,140,784 | A | 7/1964 | Goldbeck et al. | |
| 3,338,429 | A | 8/1967 | Zetzsche | |
| 3,397,483 | A | 8/1968 | Lingard | |
| 3,450,272 | A | 6/1969 | Munzing | |
| 3,468,169 | A | 9/1969 | Welch | |
| 3,469,713 | A * | 9/1969 | Edwards et al. | 213/75 TC |
| 3,564,766 | A | 2/1971 | Edwards et al. | |
| 3,608,237 | A | 9/1971 | Richter | |
| 3,609,912 | A | 10/1971 | Ernst | |
| 3,659,725 | A | 5/1972 | Passalacqua | |
| 3,831,776 | A | 8/1974 | Antonik | |
| 3,942,648 | A | 3/1976 | Edwards | |
| 4,098,411 | A | 7/1978 | Rossler | |
| 4,512,483 | A | 4/1985 | Crossley et al. | |
| 4,650,081 | A | 3/1987 | Diller | |
| 4,700,855 | A | 10/1987 | Boeniger | |
| 4,765,496 | A | 8/1988 | Diller | |
| 4,768,663 | A | 9/1988 | Schuller | |
| 4,893,716 | A | 1/1990 | Diller | |
| 5,316,158 | A | 5/1994 | Dunham | |
| 5,426,305 | A * | 6/1995 | Siebentritt et al. | 250/374 |
| 5,509,546 | A | 4/1996 | Staat | |
| 5,620,106 | A | 4/1997 | Storzek | |
| 5,662,229 | A | 9/1997 | Edwards | |

(Continued)

FOREIGN PATENT DOCUMENTS

DE 37 44 492 C1 12/1987

*Primary Examiner*—Mark T. Le
(74) *Attorney, Agent, or Firm*—Kriegsman & Kriegsman

(57) ABSTRACT

An improved model railroad coupler includes a shank having a proximal end and a distal end. The proximal end is shaped to define a joining element for attaching the model railroad coupler to a unit of model railroad rolling stock and the distal end is shaped to define a head. A knuckle having a hook is mounted on the head for limited rotational movement between a closed position and an open position. A trip pin is mounted on the knuckle for rotating the knuckle from the closed position to the open position when urged to do so. A spring which is disposed inside the shank provides a force to the knuckle to bias the knuckle to pivot into a closed position. In one embodiment of the invention the shank is a one piece member and the spring is a leaf spring which is separate from the knuckle and the shank.

31 Claims, 34 Drawing Sheets

U.S. PATENT DOCUMENTS

| | | | | |
|---|---|---|---|---|
| 5,746,336 | A | 5/1998 | Edwards | |
| 5,775,524 | A | 7/1998 | Dunham | |
| 5,785,192 | A | 7/1998 | Dunham et al. | |
| 5,823,371 | A | 10/1998 | Riley et al. | |
| 5,931,322 | A | 8/1999 | Storzek | |
| 6,095,351 | A | 8/2000 | Rossler | |
| 6,189,713 | B1 | 2/2001 | Oh | |
| 6,308,845 | B1 | 10/2001 | Sergent | |
| 2002/0172259 | A1 * | 11/2002 | Bach | 374/208 |

* cited by examiner

MODEL RAILROAD COUPLER

BACKGROUND OF THE INVENTION

The present invention relates generally to model railroads and more particularly to couplers for use in model railroads.

Model railroad couplers are well known. These devices, which are basically mechanical linkage type devices for coupling one model railroad car to another model railroad car in series, very often comprise a shank, a knuckle, a spring and a trip pin. The shank is shaped to define a joining element at one end for attaching the coupler to a unit of model railroad rolling stock. The other end of the shank is shaped to receive the knuckle. The knuckle is mounted on the shank for limited rotational movement. The spring is coupled to the knuckle and the shank is used to bias the knuckle to pivot into the closed position. The trip pin is used to remotely uncouple one coupler from another coupler to which it is attached.

In U.S. Pat. No. 5,785,192 to M. N. Dunham et al. there is disclosed a coupler of the type described above. The coupler includes a coupler shank, having a joining element at one end thereof and a coupler head at the other end thereof. A coupler-knuckle receiver is located within the coupler head and receives a coupler knuckle. The knuckle is provided with limited, rotational movement within the coupler head, through a predefined arc. The coupler head has a first knuckle stop located thereon which limits rotational movement of the coupler knuckle relative to the coupler head in a first direction of rotation. A second knuckle stop is located on one side of the coupler head adjacent to the shank. A knuckle limiter is located on the coupler knuckle. The second knuckle stop and the knuckle limiter are constructed and arranged to abut one another when the coupler knuckle is shifted to an open position, thereby stopping rotation of the coupler knuckle relative to the coupler head. A spring is carried on the second knuckle stop and the knuckle limiter extends therebetween, and is operable to urge the coupler knuckle to a closed position wherein the coupler knuckle abuts the first knuckle stop.

In U.S. Pat. No. 5,823,371 to H. L. Riley et al. there is disclosed another coupler of this type. The coupler includes a drawbar having first and second ends. The first end includes an aperture defined therethrough adapted for mounting in a coupler pocket on model railroad rolling stock. The second end includes a coupler head. A coupler knuckler is pivotably mounted to the coupler head by a magnetically actuated pivot post. A first coil spring alignment pin is located on the second end of the drawbar. A second coil spring alignment pin is located on the coupler knuckle. A coil spring is mounted between the coupler head and the coupler knuckle on the first and second coil spring alignment pins for resiliently urging the coupler knuckle to a coupled position. At least one of the first and second coil spring alignment pins includes a coil spring retainer which engages at least a portion of the coil spring to prevent the coil spring from becoming dislodged from the at least one or the first and second coil spring alignment pins.

In U.S. Pat. No. 5,662,229 to L. D. Edwards there is disclosed a model railroad coupler system which includes a draft gear box and a coupler. The coupler includes a coupler head and a coupler knuckle. An elongate coupler shank extends between the coupler head and a coupler mounting structure. The coupler mounting structure includes a mounting plate, which may have forwardly diverging sides thereto. Plural centering springs are fixed on each side of the coupler mounting plate such that when the coupler is centered, the centering springs make touching, non-flexed contact with the interior of the draft gear box and, when the coupler is pushed off-center, one of the centering springs makes flexed contact within an interior side of the draft box and the other centering spring does not make any contact with the other side of the draft box.

As can be appreciated, the couplers of the type described above are not entirely prototypical in that additional structure has been included to make the device functional. In particular, these devices have added a spring for biasing the knuckle to the closed position. The spring is located outside of the shank, is visible and is coupled to the knuckle. Such a spring is not found on prototypical couplers. Consequently, these couplers are not identical in appearance to prototypical couplers.

Other patents of interest are U.S. Pat. No. 2,658,629; U.S. Pat. No. 3,469,713; U.S. Pat. No. 3,564,766; U.S. Pat. No. 3,609,912; U.S. Pat. No. 3,659,725; U.S. Pat. No. 3,942,648; U.S. Pat. No. 5,316,158; U.S. Pat. No. 5,509,546; U.S. Pat. No. 5,746,336; U.S. Pat. No. 5,931,322; U.S. Pat. No. 6,189,713; and U.S. Pat. No. 6,308,845.

Accordingly, it is an object of this invention to provide a model railroad coupler which closely resembles prototypical couplers.

SUMMARY OF THE INVENTION

According to this invention there is provided a model railroad coupler comprising a shank having a proximal end and a distal end. The proximal end is shaped to define a joining element for attaching the model railroad coupler to a unit of model railroad rolling stock and the distal end is shaped to define a head. A knuckle is mounted on the head for limited rotational movement between a closed position and an open position. The knuckle is shaped to include a hook. A spring is disposed inside the shank and provides a force to the knuckle to bias the knuckle to pivot into the closed position. A trip pin is mounted on the knuckle for rotating the knuckle from the closed position to the open position when urged to do so in order to remotely uncouple one coupler from another coupler to which it may be attached.

The shank can be either a single piece or a two piece member and the spring can be either a leaf spring, a compression spring or a tension-spring. If the spring is a leaf spring, it can either be separate from the shank and the knuckle or integrally formed with the shank or integrally formed with the knuckle.

In some embodiments of the invention, the trip pin also serves to rotably fix the knuckle within the head, while in other embodiments of the invention a sleeve fixedly mounted on the knuckle serves to rotably fix the knuckle within the head.

Because the above mentioned spring is disposed inside the shank and thus not visible, the model railroad coupler more closely resembles a prototypical model railroad coupler than does prior art model railroad couplers.

BRIEF DESCRIPTION OF THE DRAWINGS

In the drawings wherein like reference numerals represent like parts.

DETAILED DESCRIPTION OF PREFERRED EMBODIMENTS

Figure 1:
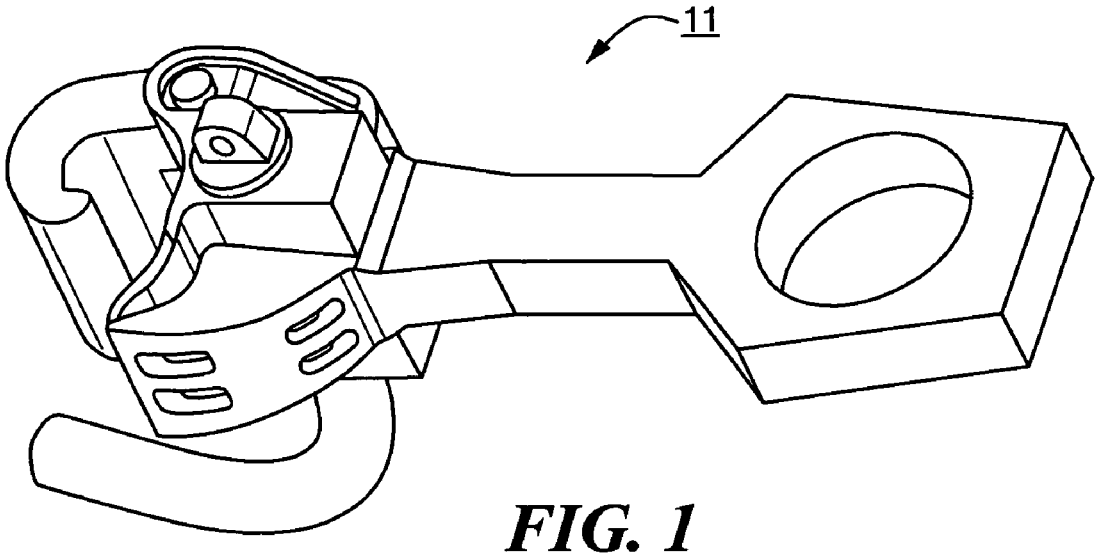
FIG. 1 is perspective view taken from the top of one embodiment of model railroad coupler constructed according to this invention.
Figure 2B:
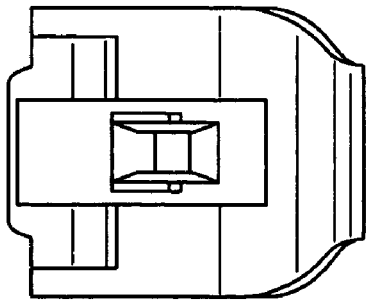
FIG. 2B is an end view of the shank shown in FIG. 2A; portion of the model railroad coupler being shown in a closed position.
Figure 2A:
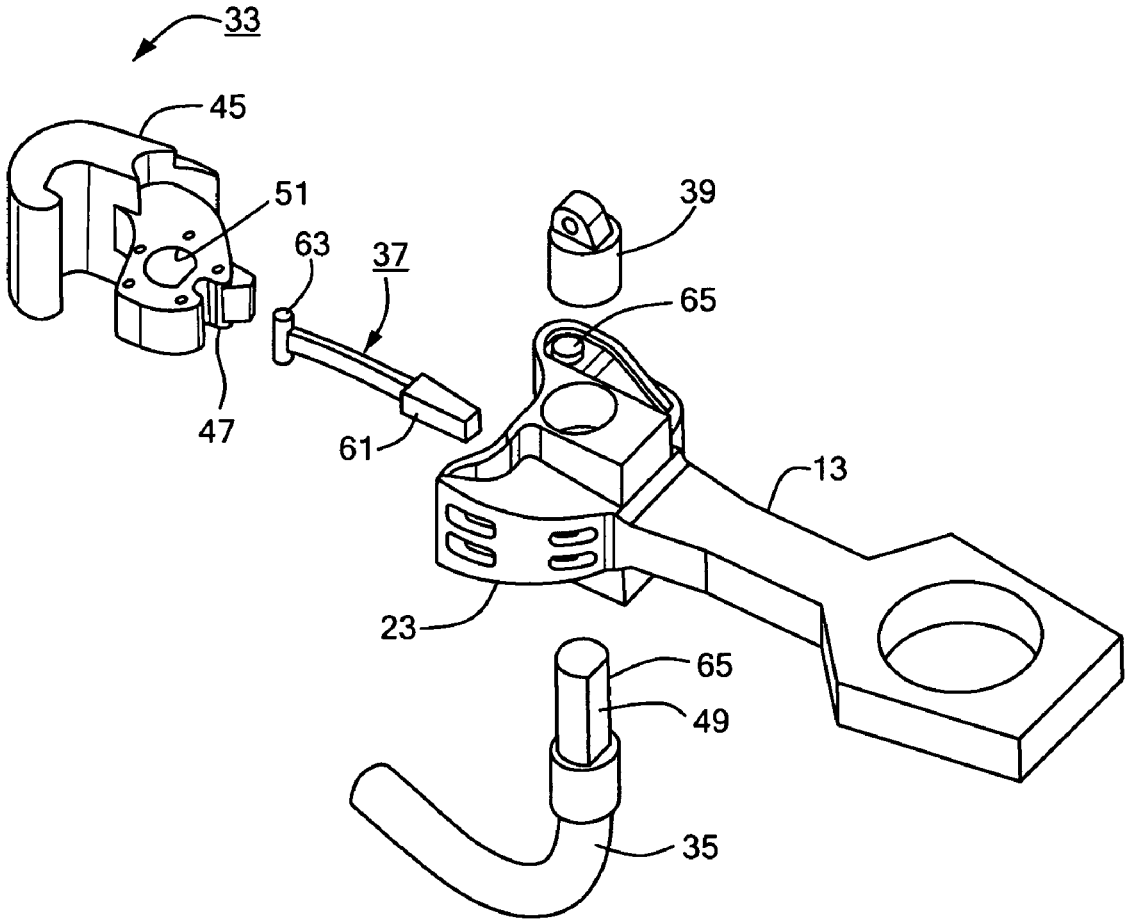
FIG. 2A is an exploded perspective view of the model railroad coupler shown in FIG. 1.

Referring now to the drawings, there is shown in FIGS. 1 through 7, an embodiment of a model railroad coupler constructed according to this invention and identified by reference numeral 11.

Model railroad coupler 11 includes a shank 13, which is a solid, one-piece member and which has a proximal end 15 and a distal end 17. Proximal end 15 of shank 13 is shaped to define a joining element in the form of a circular opening 19, for attaching model railroad coupler 11 to a model railroad rolling stock. Distal end 17 of shank 13 is shaped to define a head 21 having a proximal end 23 and a distal end 25. A channel 27 extends inward from distal end 25 of head into shank 13. Channel 27 is generally rectangular in cross-section and decreases in cross-sectional area from its front end 29 to its rear end 31.

Model railroad coupler 11 further includes a knuckle 33, a trip pin 35, a leaf spring 37 and an endcap 39.

Figure 3:
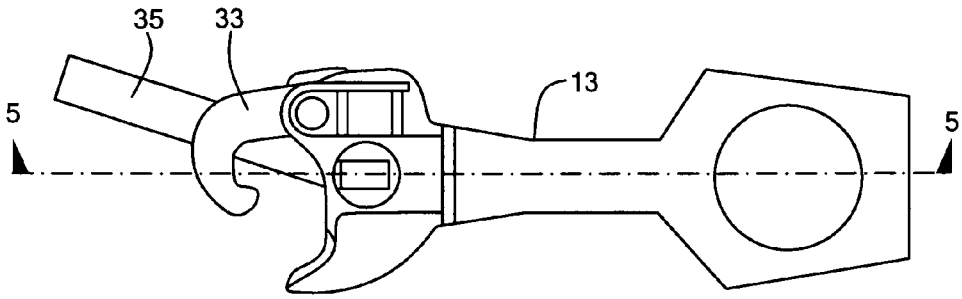
FIG. 3 is a top view of the model railroad coupler shown in FIG. 1, the knuckle portion of the model railroad coupler being shown in a closed position.
Figure 4:
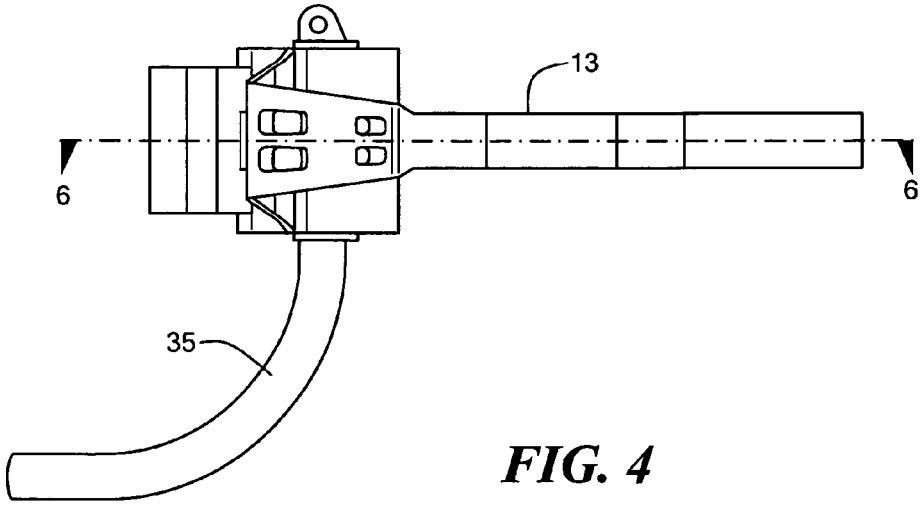
FIG. 4 is a side elevation view of the model railroad coupler shown in FIG. 1.
Figure 5A:
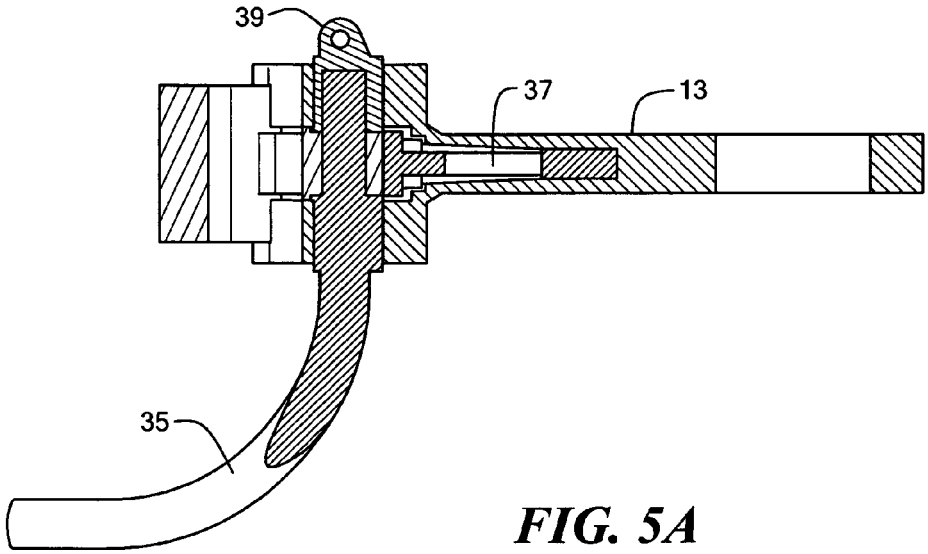
FIG. 5A is a section view taken along lines 5—5 in FIG. 3.
Figure 5B:
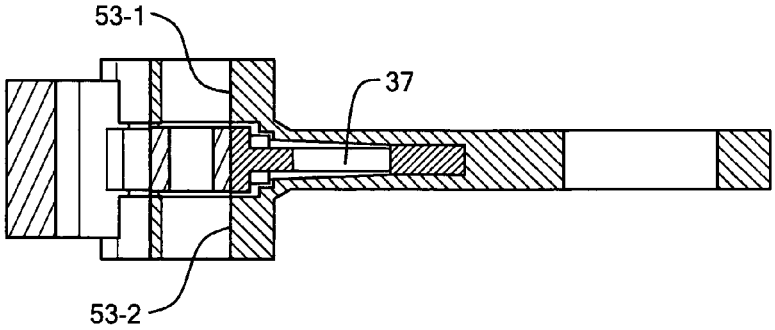
FIG. 5B is a view of the shank and knuckle shown in FIG. 5A.
Figure 6:
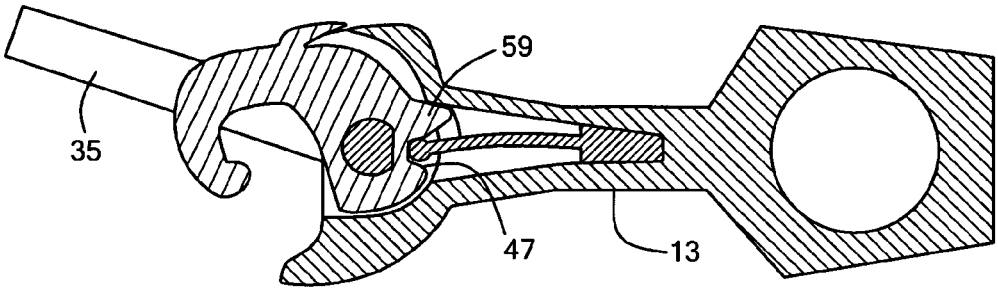
FIG. 6 is a section view taken along lines 6—6 in FIG. 4; with the knuckle portion of the model railroad coupler being in closed position.

Knuckle 33 is mounted on a knuckle receiver portion 41 of head 21 for limited rotational movement about a pivot axis 43 between a closed position and an open position. In FIG. 3, knuckle 33 is shown in a closed position while in FIG. 7, knuckle 33 is shown in an open position. Knuckle 33 is a unitary structure and includes a hook 45 for engaging a hook on a companion model railroad coupler to which model railroad coupler 11 may be attached. Knuckle 33 is also shaped to include a recess 47 into which is disposed one end of a leaf spring 37 as will hereinafter be explained.

Trip pin 35 has a keyed top portion 49 which is press fit into a matingly shaped bore 51 in knuckle 33 which is axially aligned with a two part bore 53 in head 21 of shank 13, one part of which 53-1 is in the lower portion of head 21 and the other part of which 53-2 is in the upper portion of head 21. Thus, rotation of trip pin 35 within shank 13 will carry with it rotation of knuckle 33.

Figure 7A:
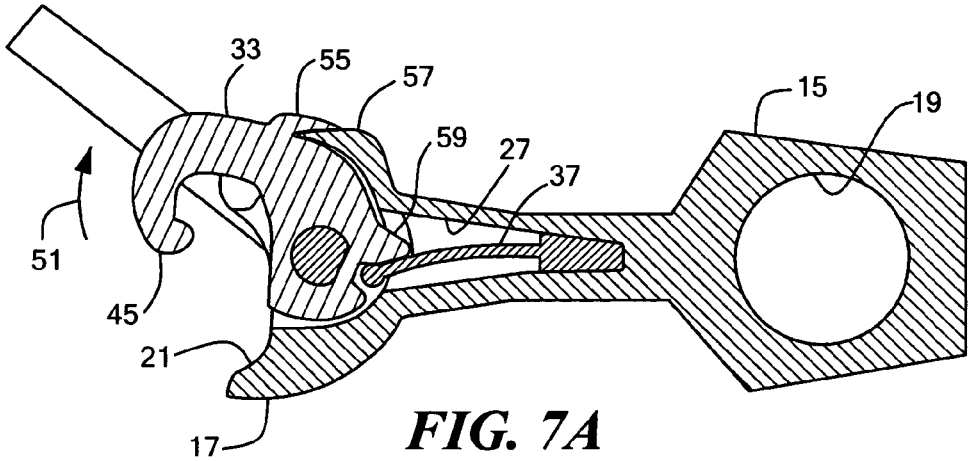
FIG. 7A is a section view similar to FIG. 6 but with the knuckle position of the model railroad coupler being in an open position.
Figure 7B:
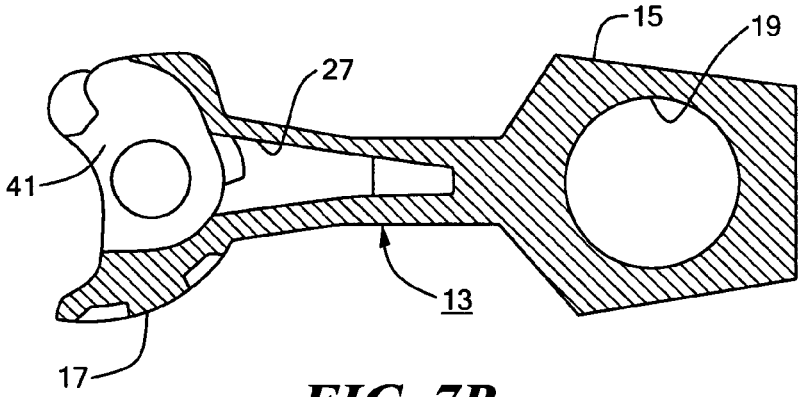
FIG. 7B is a view of the shank shown in FIG. 7A.

Trip pin 35 serves two functions; first, it rotably fixes knuckle 33 within head 21 of shank 13 and second, when urged to do so, will rotate knuckle 33 within shank 13 from the closed position to the open position. Trip pin 35 is made of a ferrous material and is designed to simulate in shape an air hose in a prototype rolling stock coupler. As is well known in the art of model railmaking, when coupler 11 comes within an appropriate magnetic field, pin 35 will be urged in the direction of arrow 51 carrying with it knuckle 33 to the open position as shown in FIG. 7.

A flange 55 on knuckle 33 cooperates with a portion of the outer surface 57 of shank 13 to provide a stop to limit movement of knuckle 33 to the open position while a projection 59 on the rear of knuckle 33 and the wall of 27 cooperate to provide a stop to limit movement of knuckle 33 to the open position.

Leaf spring 37 is a unitary member which is separate from shank 13 and knuckle 33. Leaf spring 37 has a tapered proximal end 61 so that it can be press fit into rear end 31 of channel 27, a cylindrically shaped distal end 63 which extends out beyond the front end 29 of channel into recess 47 in knuckle 33 and an elongated intermediate portion 65 between ends 61 and 63. The purpose of leaf spring 37 is to provide a force to bias knuckle 33 to the closed position.

End cap 39 is mounted on the upper end 65 of pin 35.

Projection 65 has no function but rather serves to simulate in appearance the knuckle pivot post on a prototype coupler.

Shank 13, spring 37 and end cap 39 are preferably made of glass fiber filled liquid crystal polymer or other higher strength plastic matrices such as polyester or AVS.

Knuckle 33 is preferably made of carbon fiber filled liquid crystal polymer or other suitable plastic materials such as Teflon augmented plastic so that it will easily slide within shank 13.

Coupler 11 operates in a manner similar, for example, to the coupler in U.S. Pat. No. 5,785,192.

Coupler 11 is assembled in the following manner. First, leaf spring 37 is pushed into channel 27 of shank 13. Then, knuckle 33 is inserted into knuckle receiver 41 in head 21. Then, trip pin 35 is inserted through bottom part 53-1 of bore 53, through bore 51 in knuckle 33 and then through top part 53-2 of bore 53. Then end cap 39 is pushed onto the top end of trip pin 35.

As can be appreciated, since leaf spring 37 is disposed inside shank 13 and thus not visible, model railroad coupler 11 more closely resembles a prototype coupler than prior art model railroad couplers.

In the operation of model railroad coupler 11, leaf spring 37 biases knuckle 17 to the closed position and trip pin 35 when actuated will move knuckle to the open position.

Figure 8:
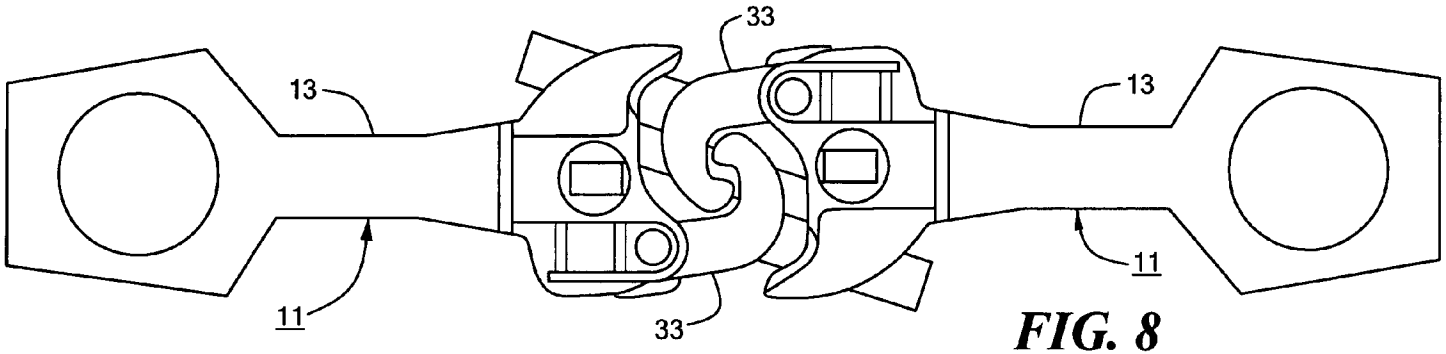
FIG. 8 is a top view showing two model railroad couplers as shown in FIG. 1 coupled together.
Figure 9:
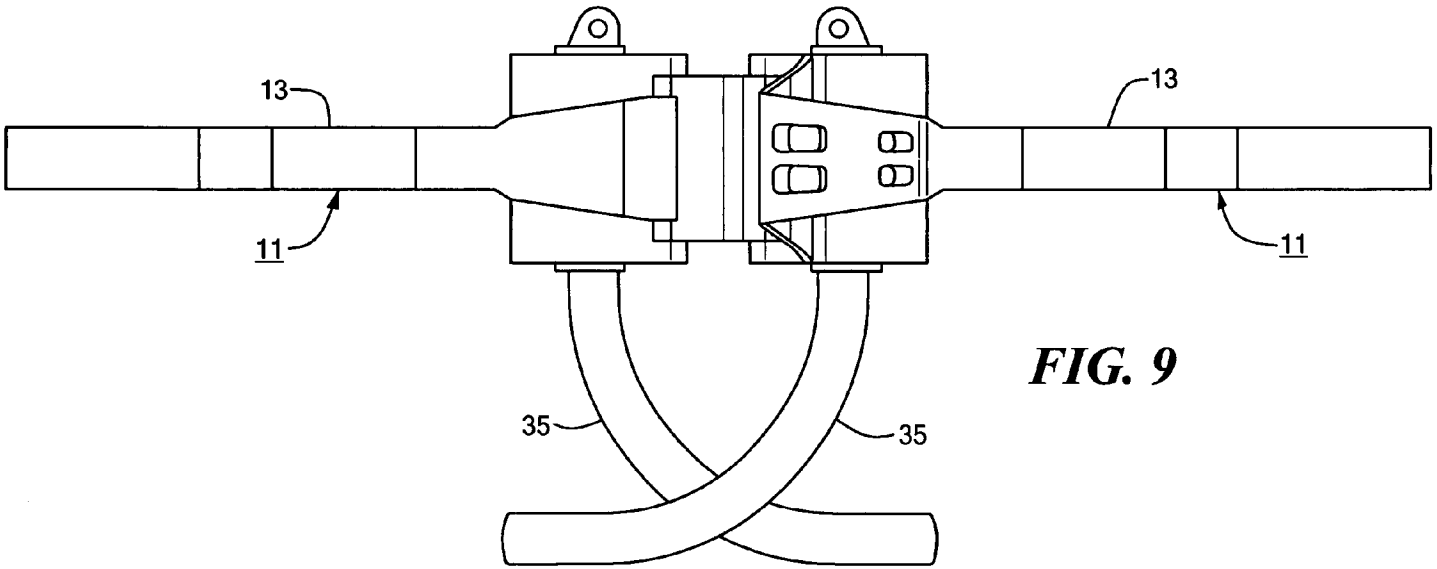
FIG. 9 is a side elevation view of the two coupled together model railroad couplers shown in FIG. 8.
Figure 10:
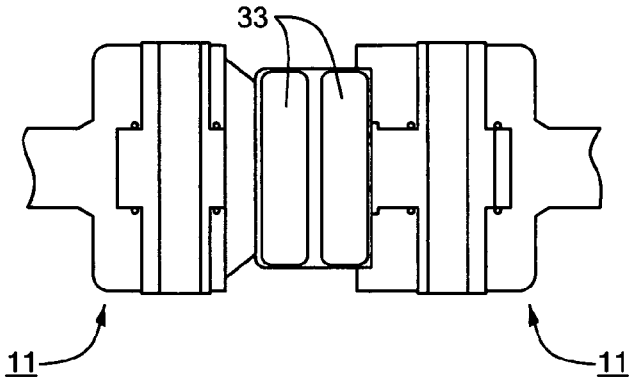
FIG. 10 is a section view taken along lines 9—9 in FIG. 9.
Figure 11:
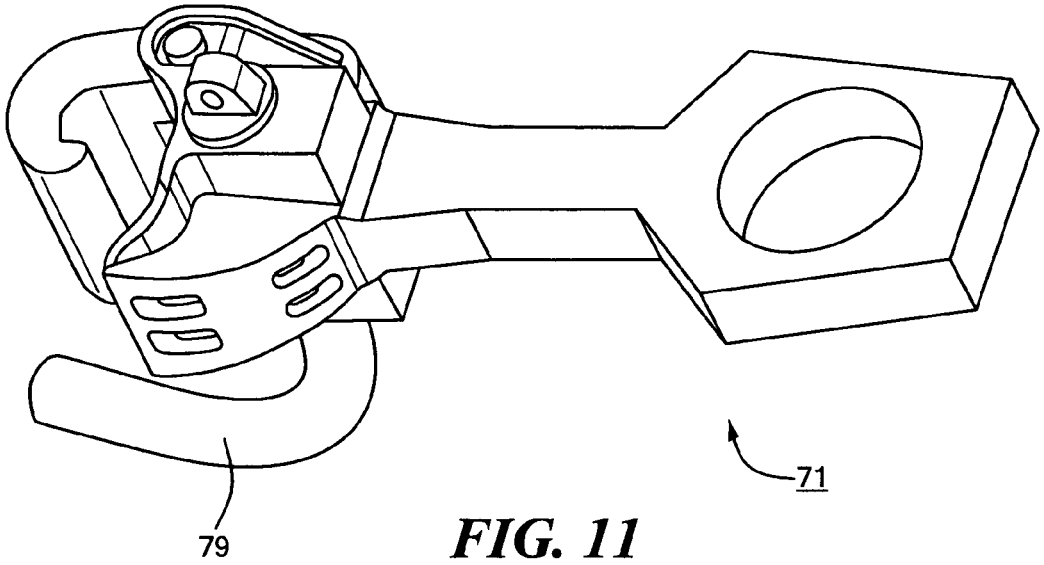
FIG. 11 is a perspective view taken from the top of another embodiment of a model railroad coupler constructed according to this invention.
Figure 12:
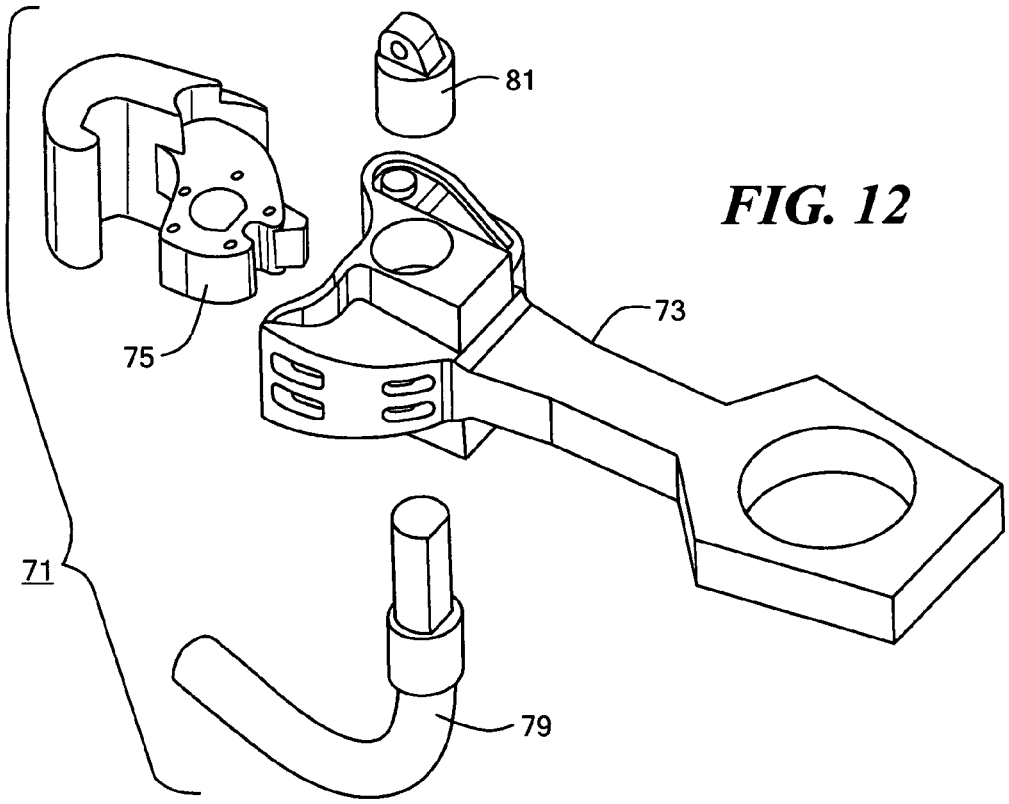
FIG. 12 is an exploded perspective view of the model railroad coupler shown in FIG. 10.
Figure 13:
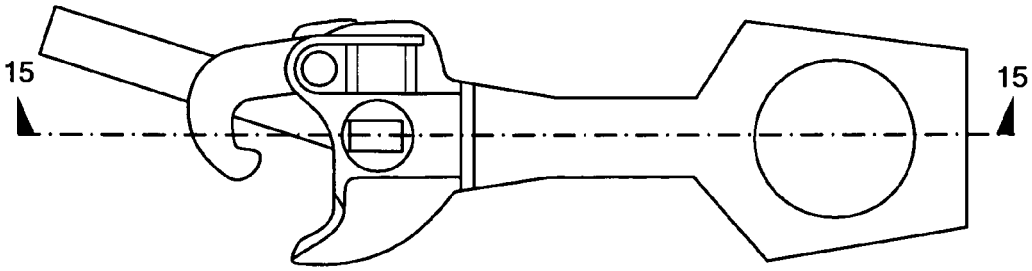
FIG. 13 is a top view of the model railroad coupler shown in FIG. 11.
Figure 14:
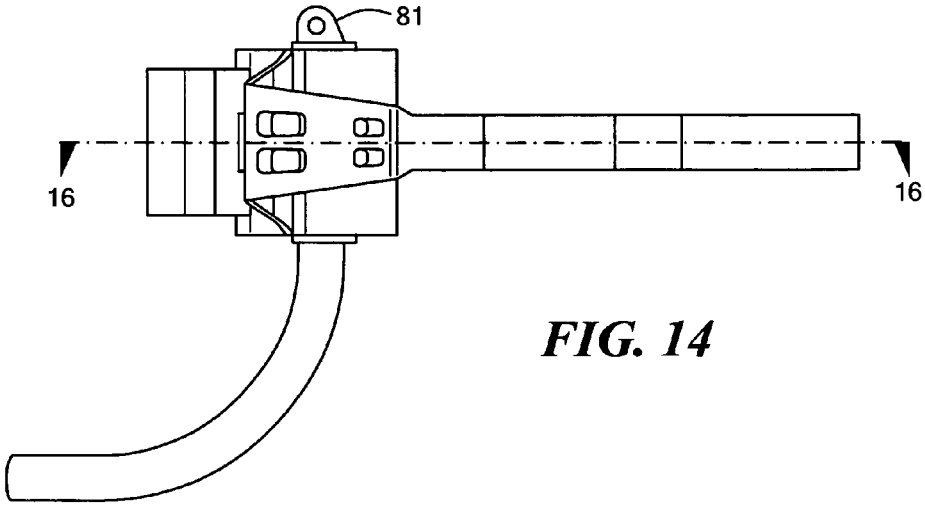
FIG. 14 is a side elevation view of the model railroad coupler shown in FIG. 10.
Figure 15:
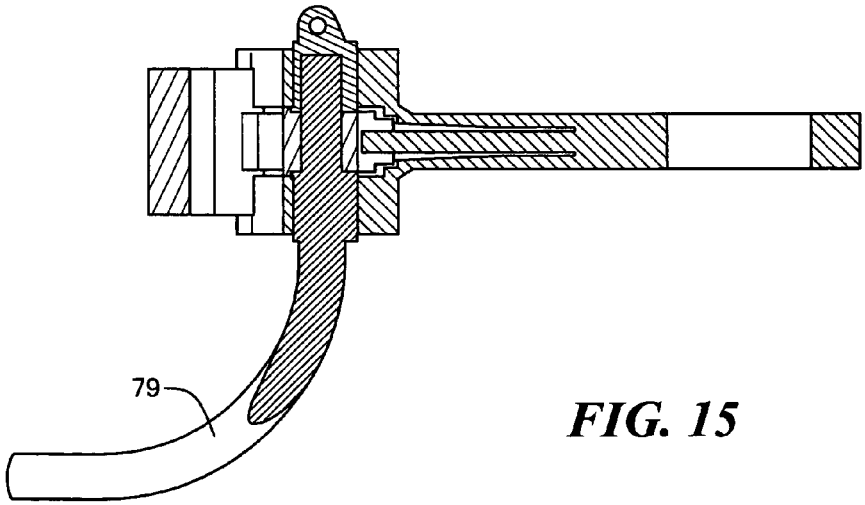
FIG. 15 is a section view taken along lines 15—15 in FIG. 13.
Figure 16:
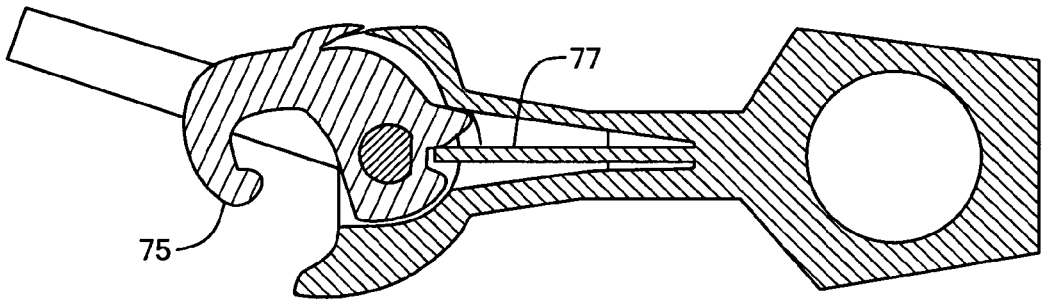
FIG. 16 is a section view taken along lines 16—16 in FIG. 14.
Figure 17:
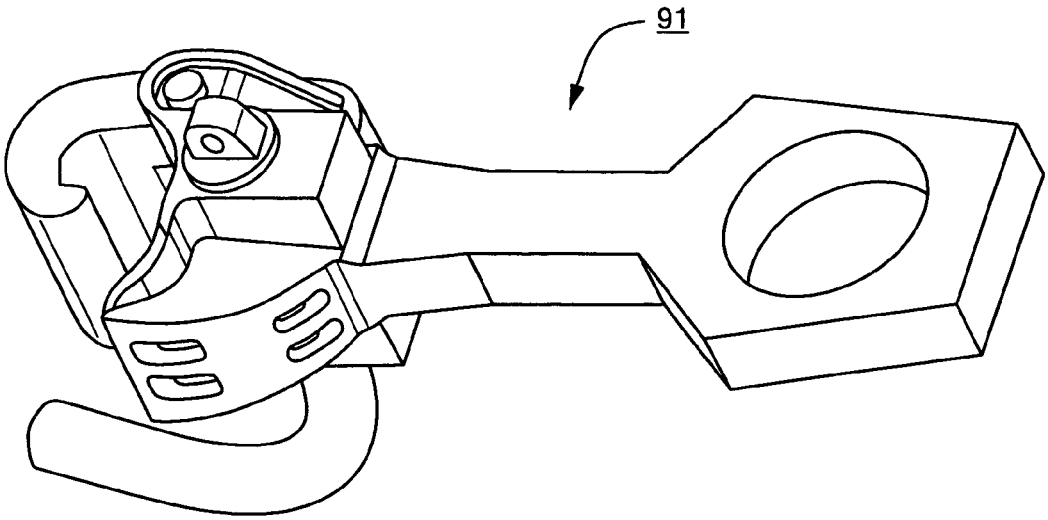
FIG. 17 is a perspective view taken from the top of another embodiment of a model railroad coupler constructed according to this invention.
Figure 18:
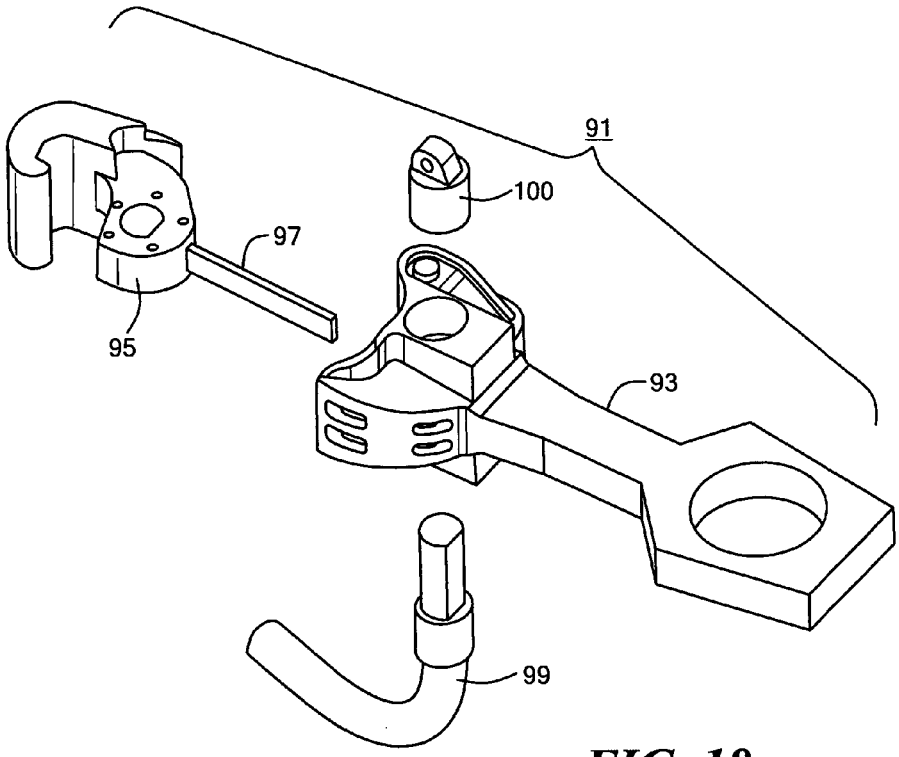
FIG. 18 is an exploded perspective view of the model railroad coupler shown in FIG. 17.
Figure 19:
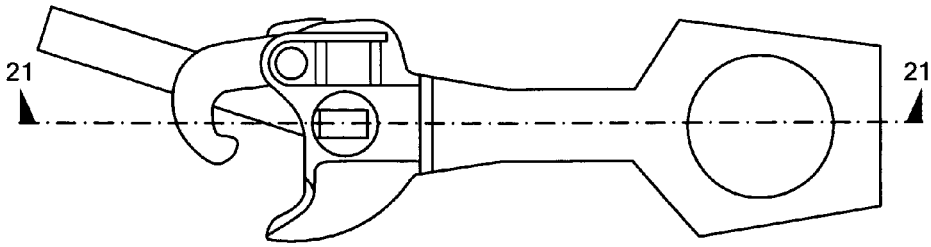
FIG. 19 is a top view of the model railroad coupler shown in FIG. 17.
Figure 20:
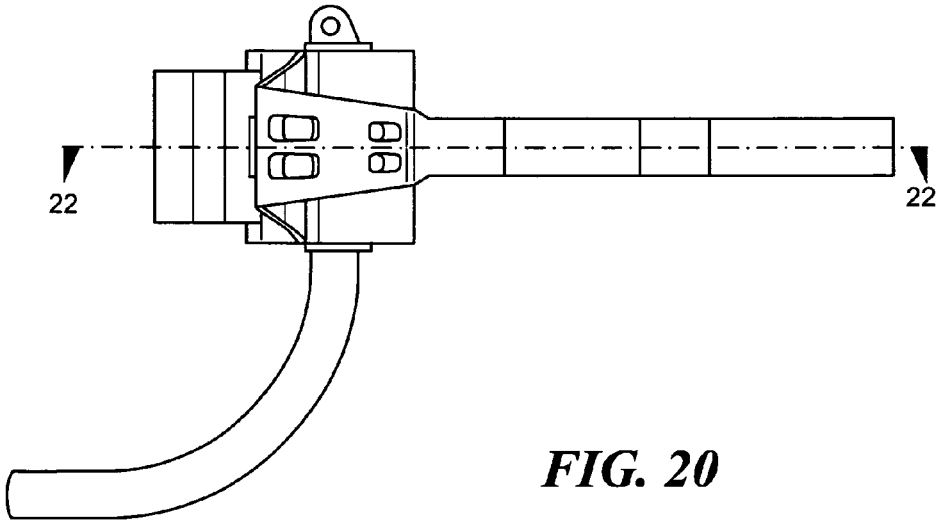
FIG. 20 is a side elevation of the model railroad coupler shown in FIG. 17.
Figure 21:
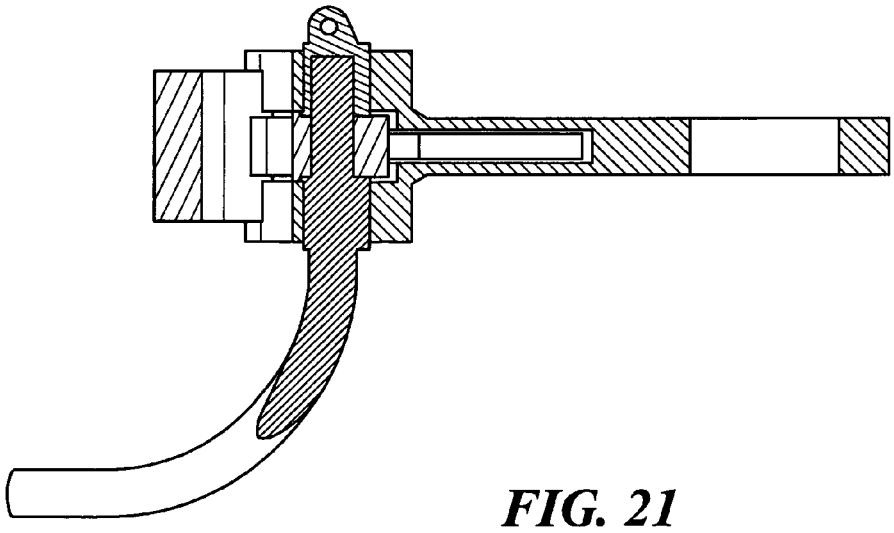
FIG. 21 is a section view taken along lines 21—21 in FIG. 19.
Figure 22:
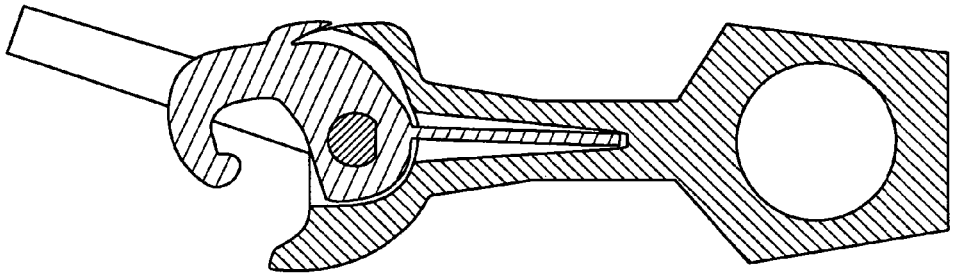
FIG. 22 is a section view taken along lines 22—22 in FIG. 20.
Figure 23:
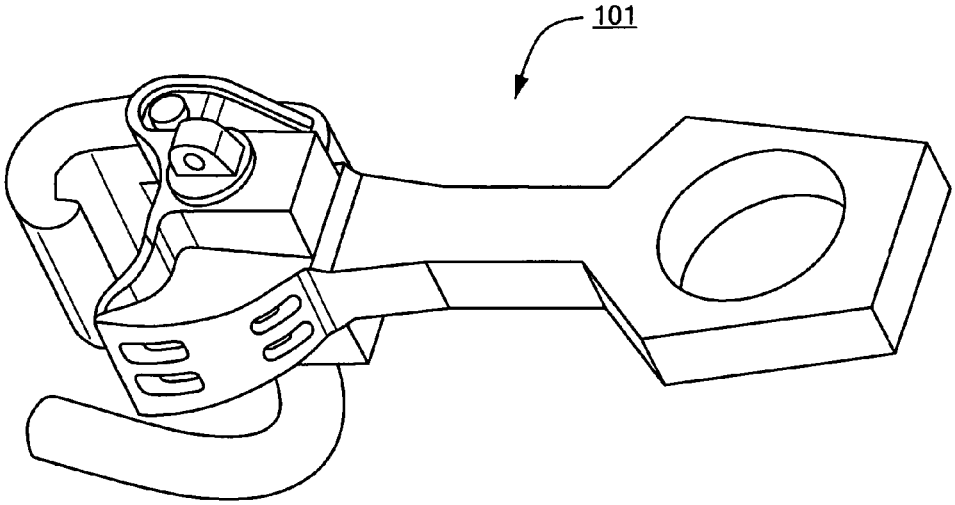
FIG. 23 is a perspective view taken from the top of another embodiment of a model railroad coupler constructed according to this invention.
Figure 24:
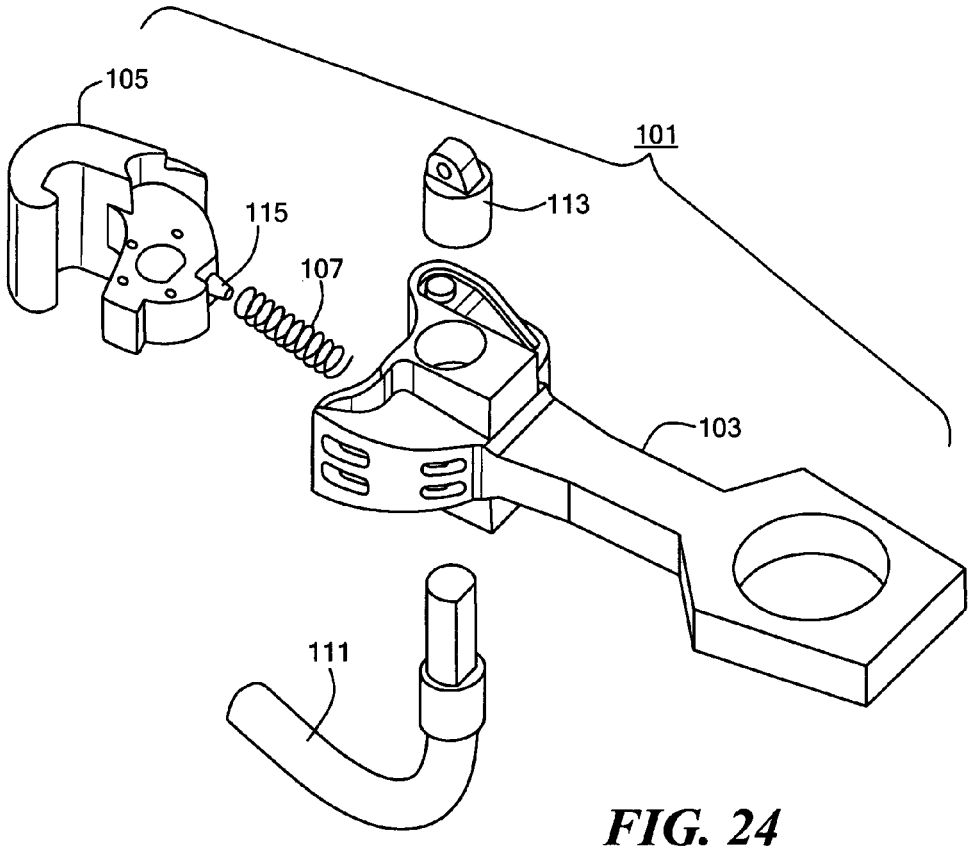
FIG. 24 is an exploded perspective view of the model railraod coupler shown in FIG. 23.
Figure 25:
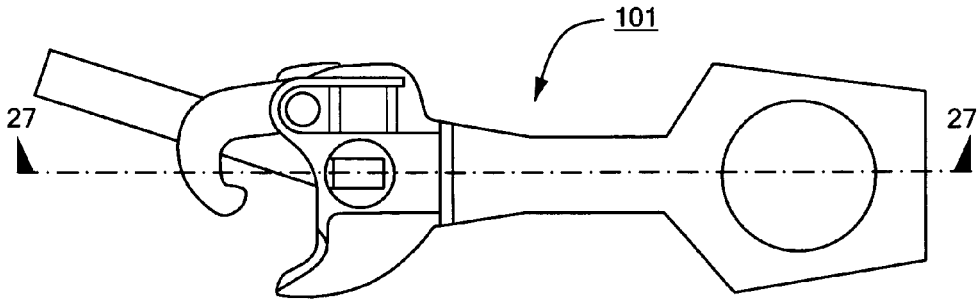
FIG. 25 is a top view of the model railroad coupler shown in FIG. 23.
Figure 26:
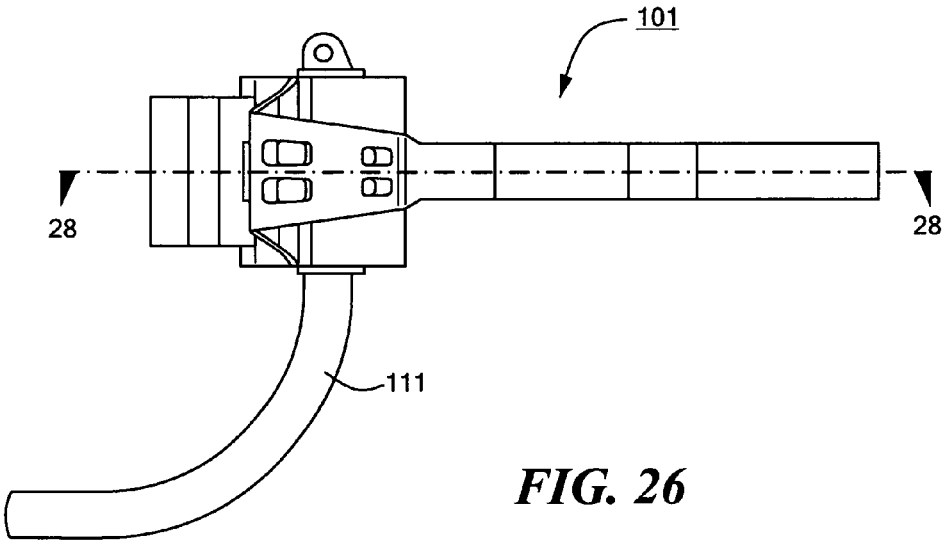
FIG. 26 is a side elevation of the model railroad coupler shown in FIG. 23.
Figure 27:
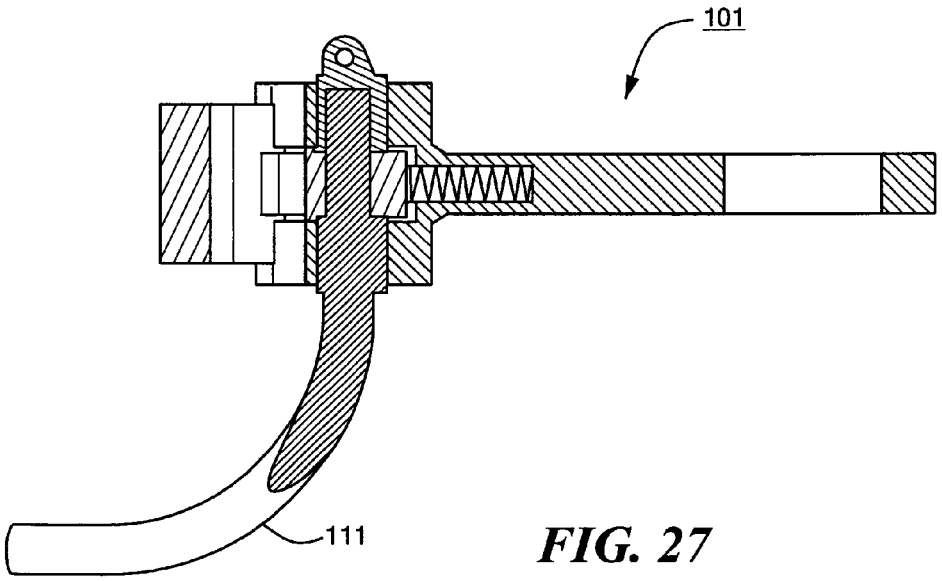
FIG. 27 is a section view taken along lines 27—27 in FIG. 25.
Figure 28:
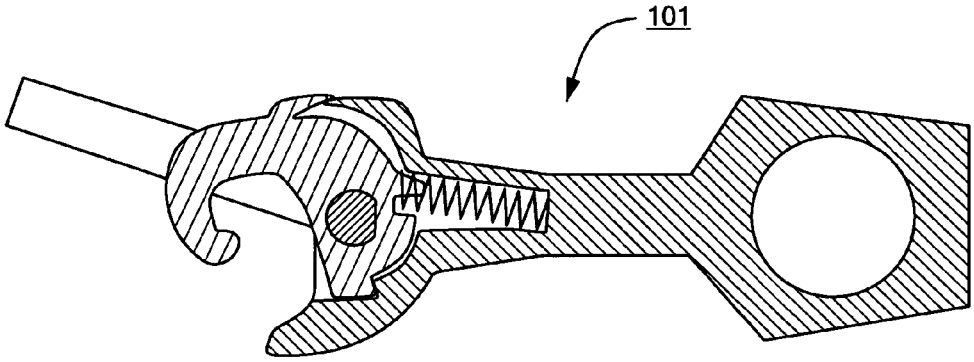
FIG. 28 is a section view taken along lines 28—28 in FIG. 26.
Figure 29:
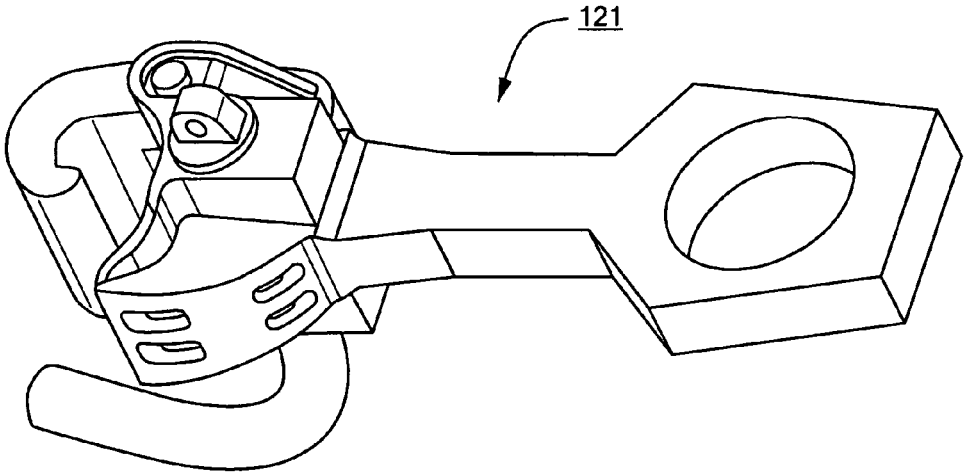
FIG. 29 is a perspective view taken from the top of another embodiment of a model railroad coupler constructed according to this invention.
Figure 30:
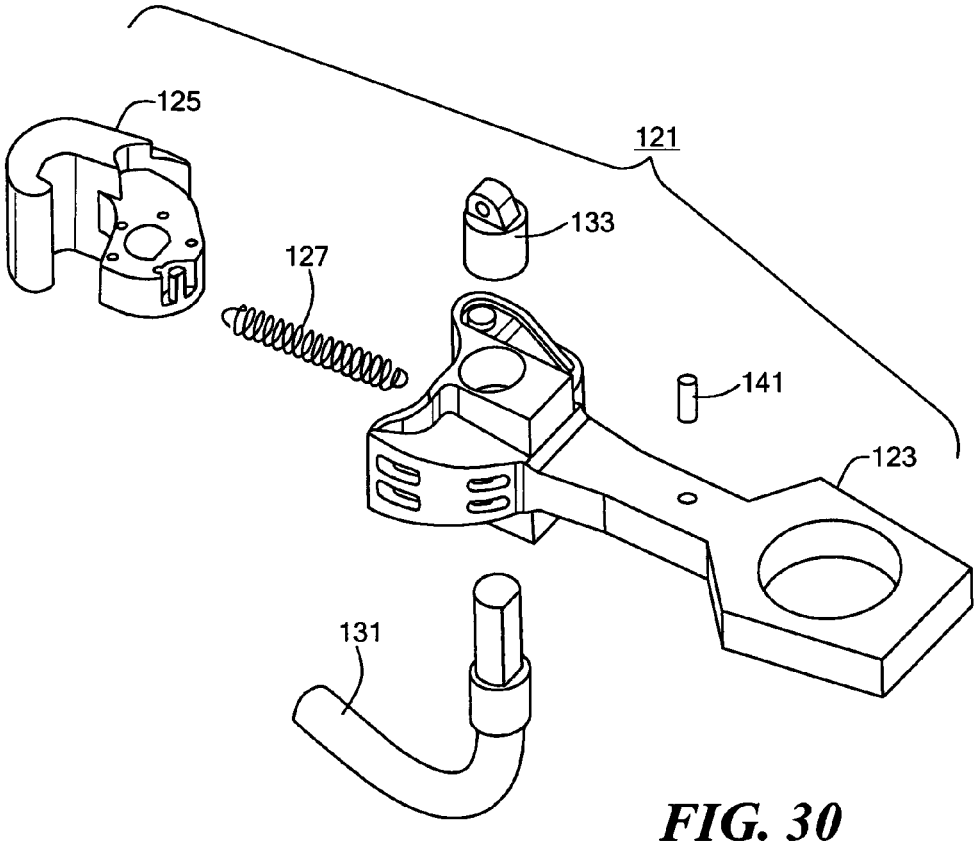
FIG. 30 is an exploded perspective view of the model railroad coupler shown in FIG. 29.
Figure 31:
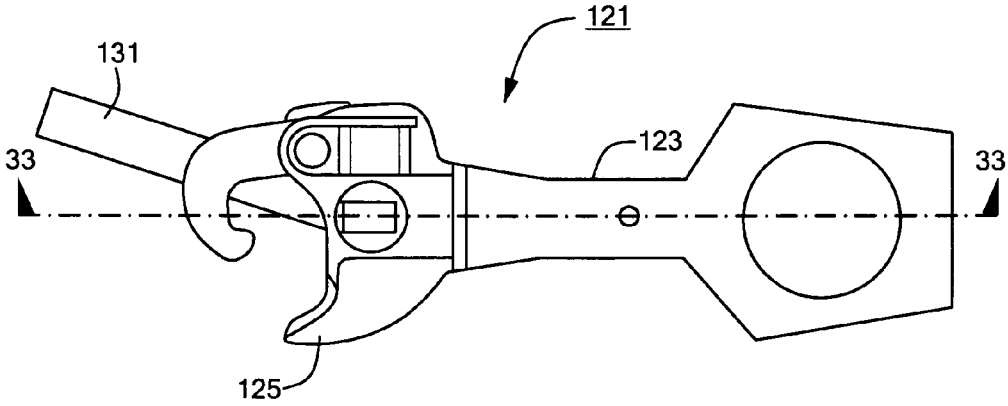
FIG. 31 is a top view of the model railroad coupler shown in FIG. 29.
Figure 32:
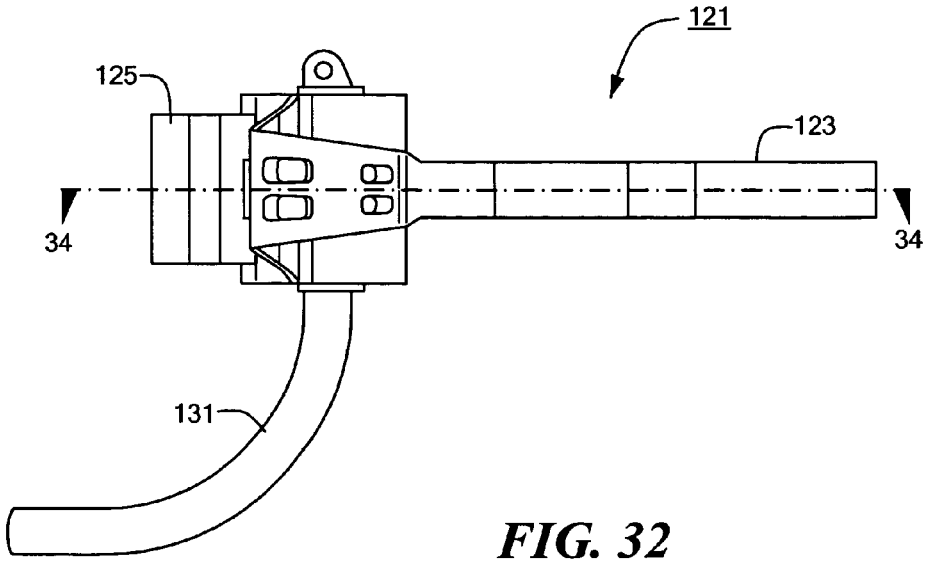
FIG. 32 is a side elevation of the model railroad coupler shown in FIG. 29.
Figure 33:
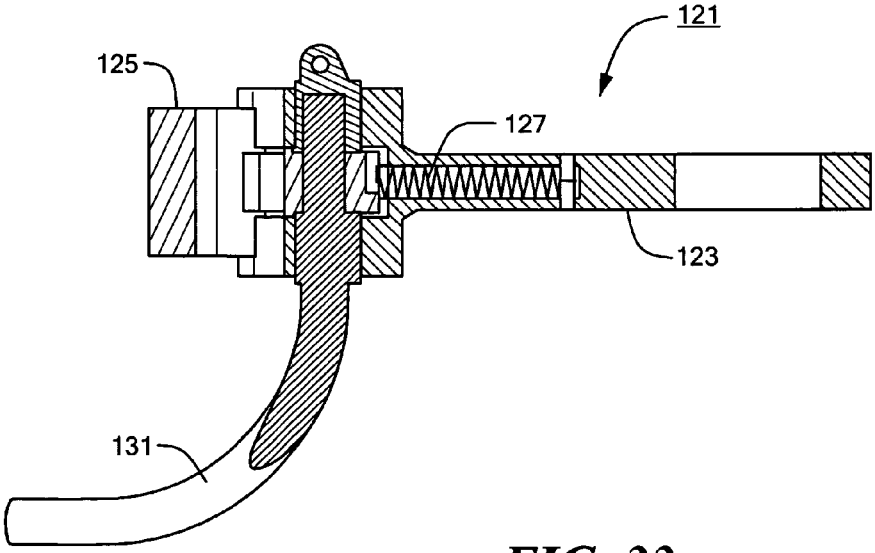
FIG. 33 is a section view taken along lines 33—33 in FIG. 31.
Figure 34:
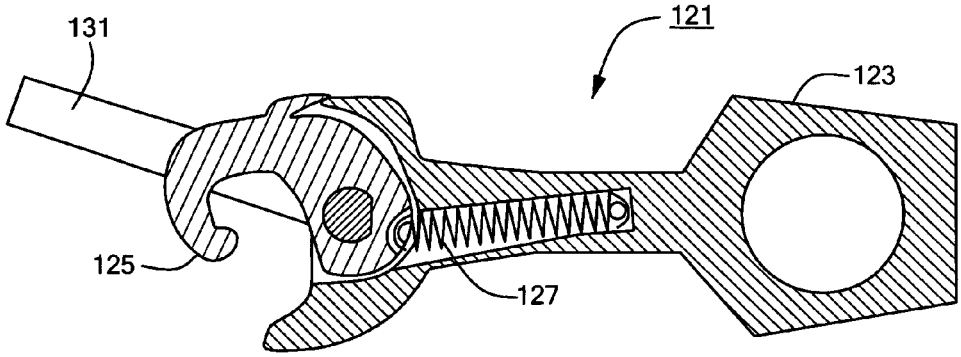
FIG. 34 is a section view taken along lines 34—34 in FIG. 32.
Figure 35:
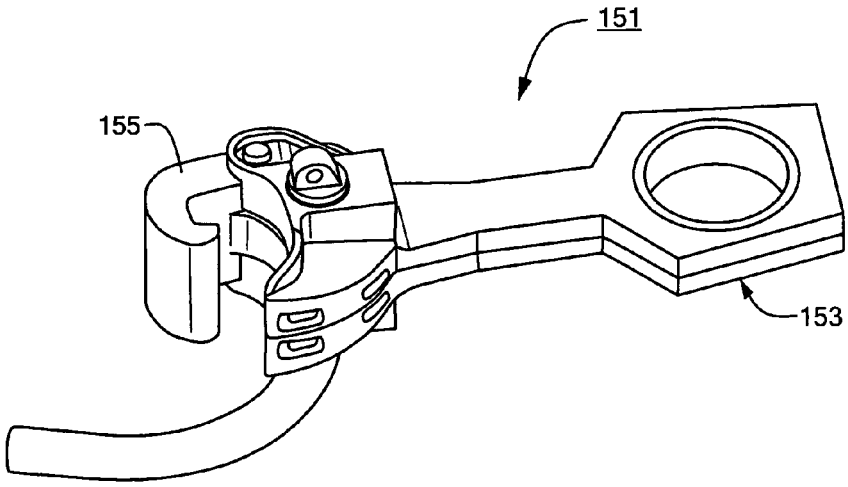
FIG. 35 is a perspective view taken from the top of another embodiment of a model railroad coupler constructed according to this invention.
Figure 36:
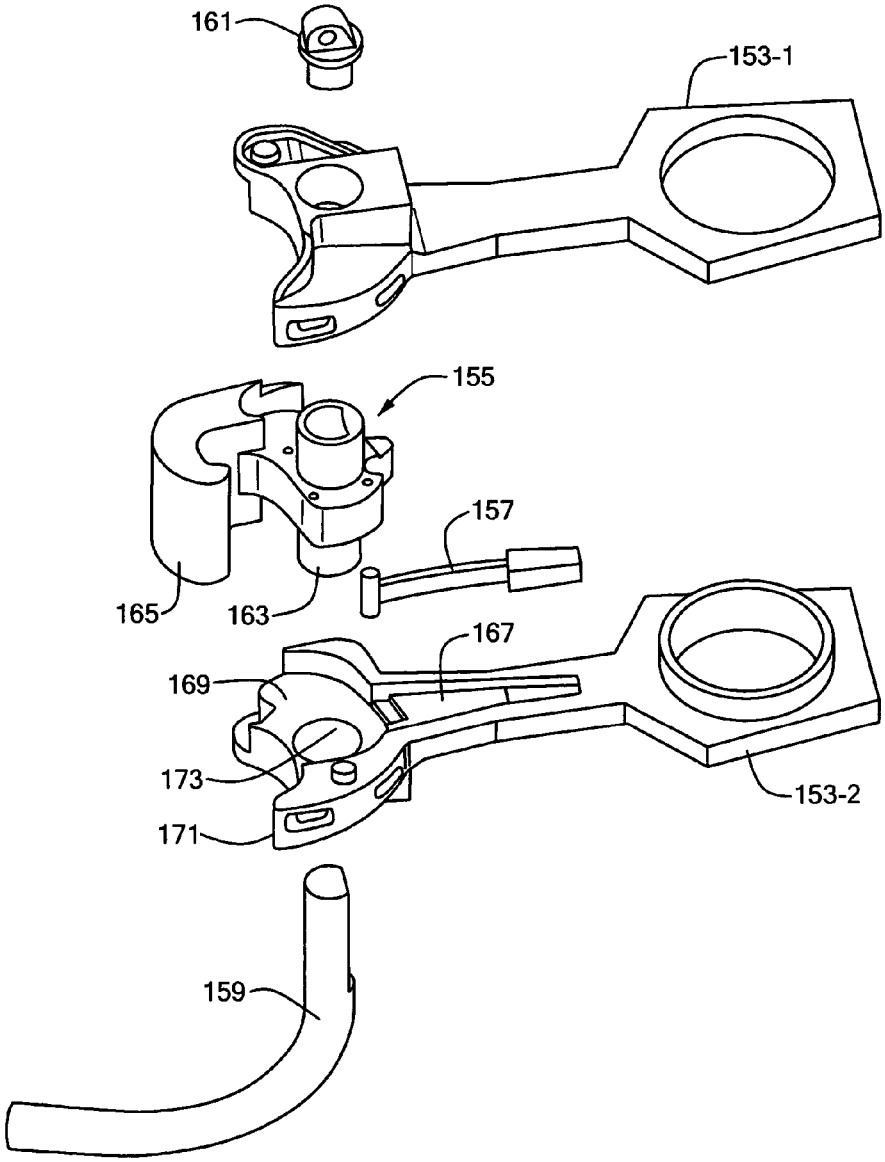
FIG. 36 is an exploded perspective view of the model railroad coupler shown in FIG. 35.
Figure 37:
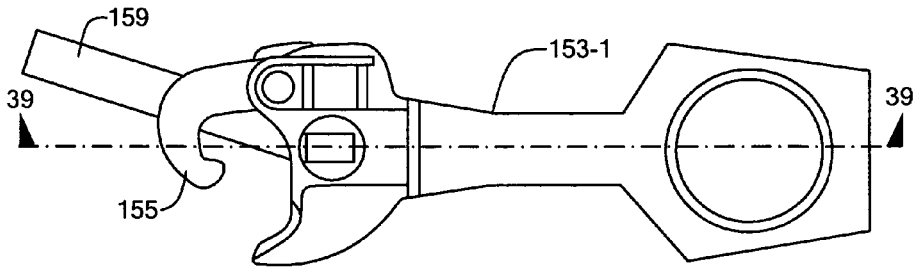
FIG. 37 is a top view of the model railroad coupler shown in FIG. 35.
Figure 38:
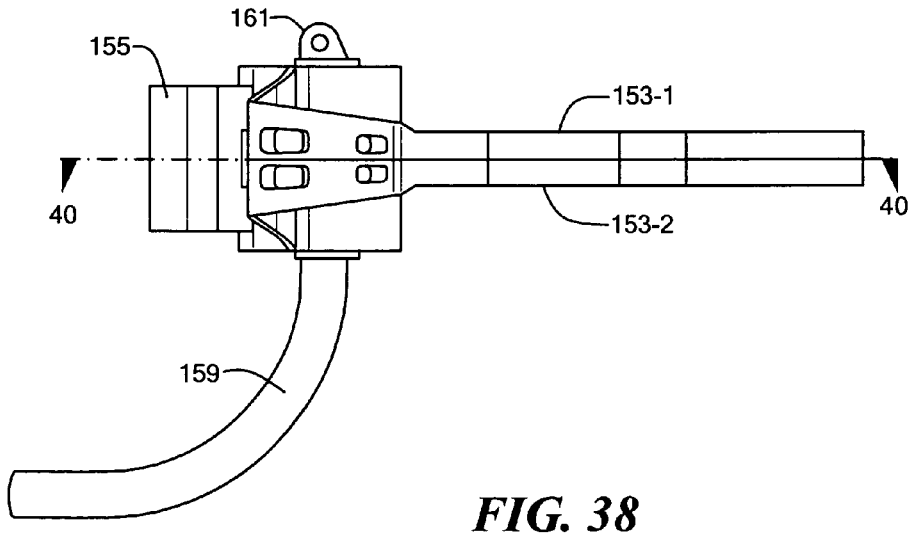
FIG. 38 is a side elevation of the model railroad coupler shown in FIG. 35.
Figure 39:
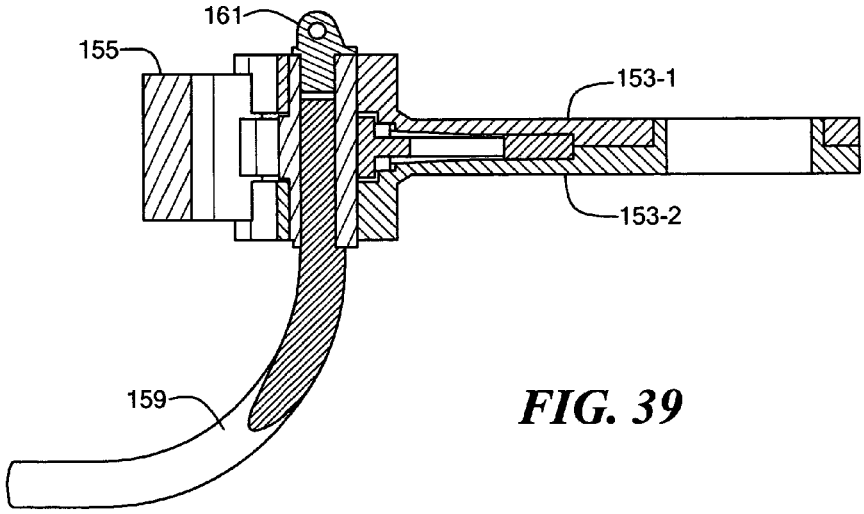
FIG. 39 is a section view taken along lines 39—39 in FIG. 37.
Figure 40:
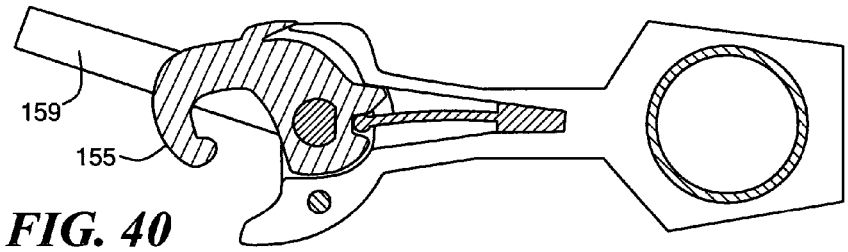
FIG. 40 is a section view taken along lines 40—40 in FIG. 38.
Figure 41:
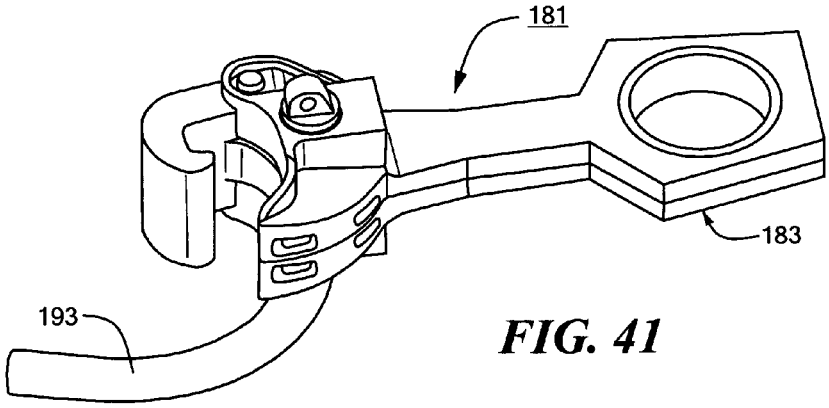
FIG. 41 is a perspective view taken from the top of another embodiment of a model railroad coupler constructed according to this invention.
Figure 42:
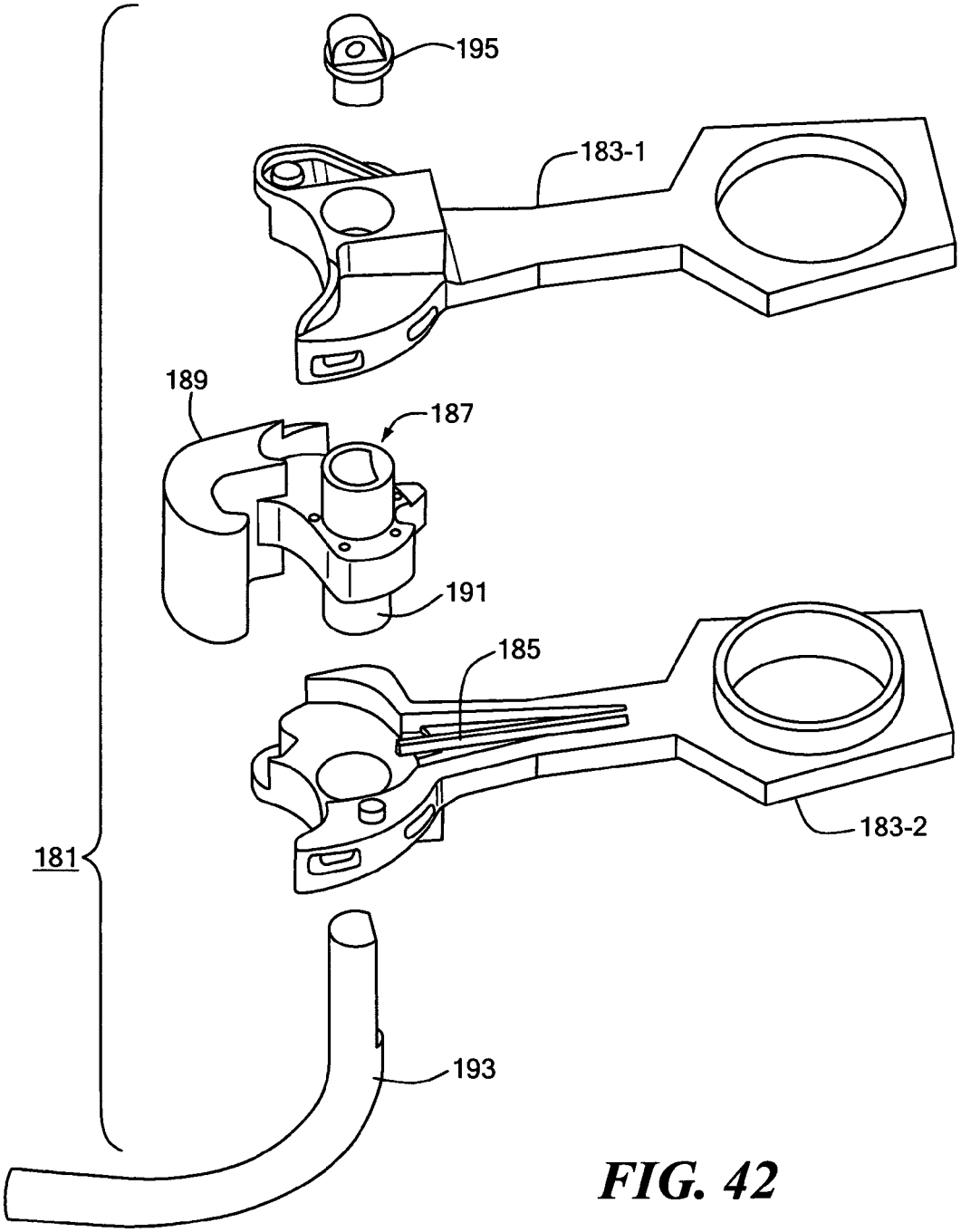
FIG. 42 is an exploded perspective view of the model railroad coupler shown in FIG. 41.
Figure 43:
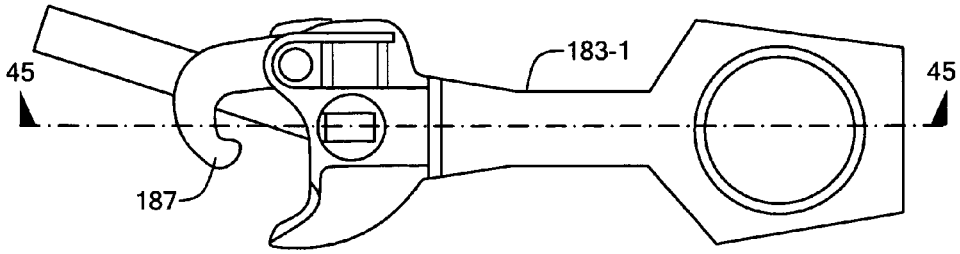
FIG. 43 is a top view of the model railroad coupler shown in FIG. 41.
Figure 44:
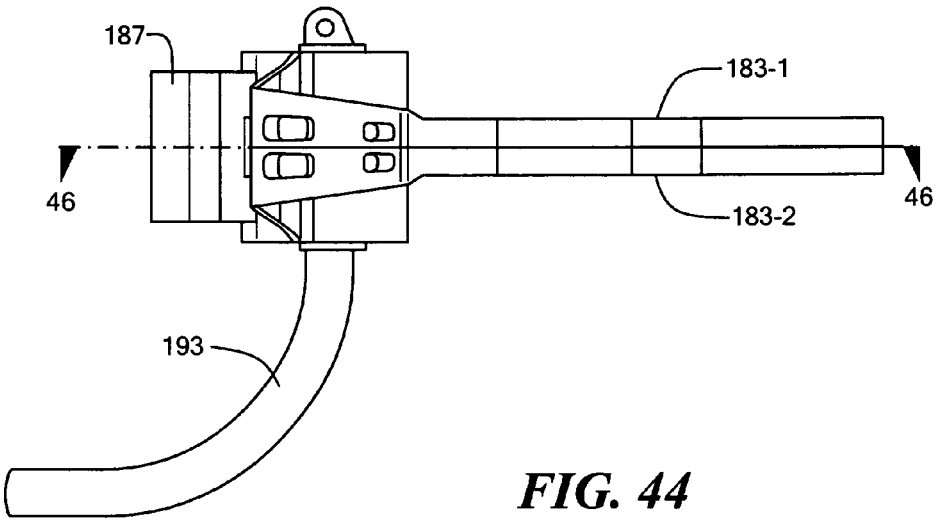
FIG. 44 is side elevation of the model railroad coupler shown in FIG. 41.
Figure 45:
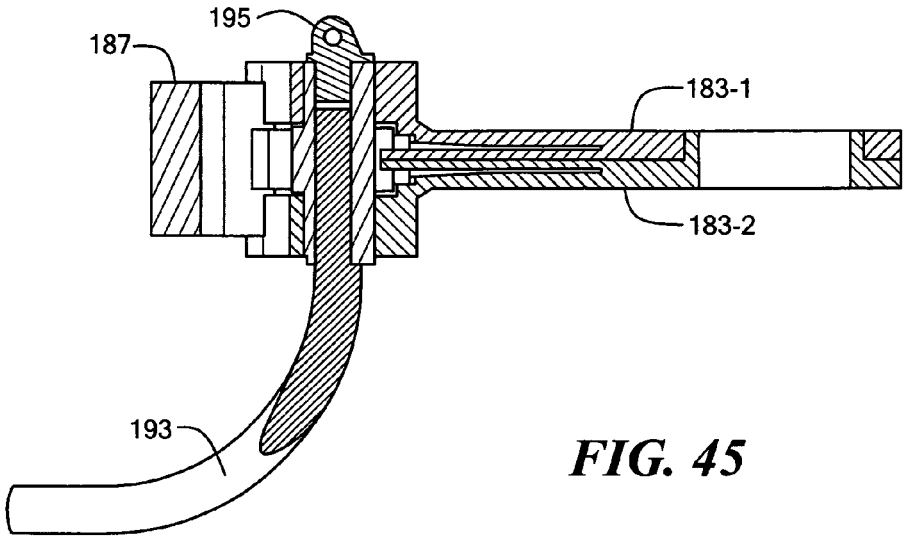
FIG. 45 is a section view taken along lines 45—45 in FIG. 43.
Figure 46:
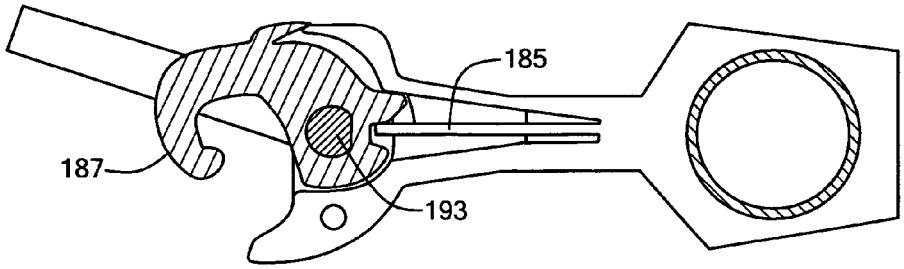
FIG. 46 is a section view taken along lines 46—46 in FIG. 43.
Figure 47:
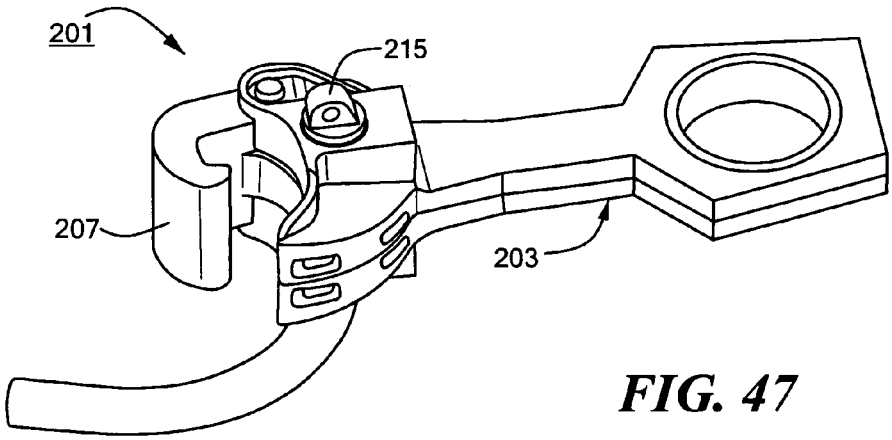
FIG. 47 is a perspective view taken from the top of another embodiment of a model railroad coupler constructed according to this invention.
Figure 48:
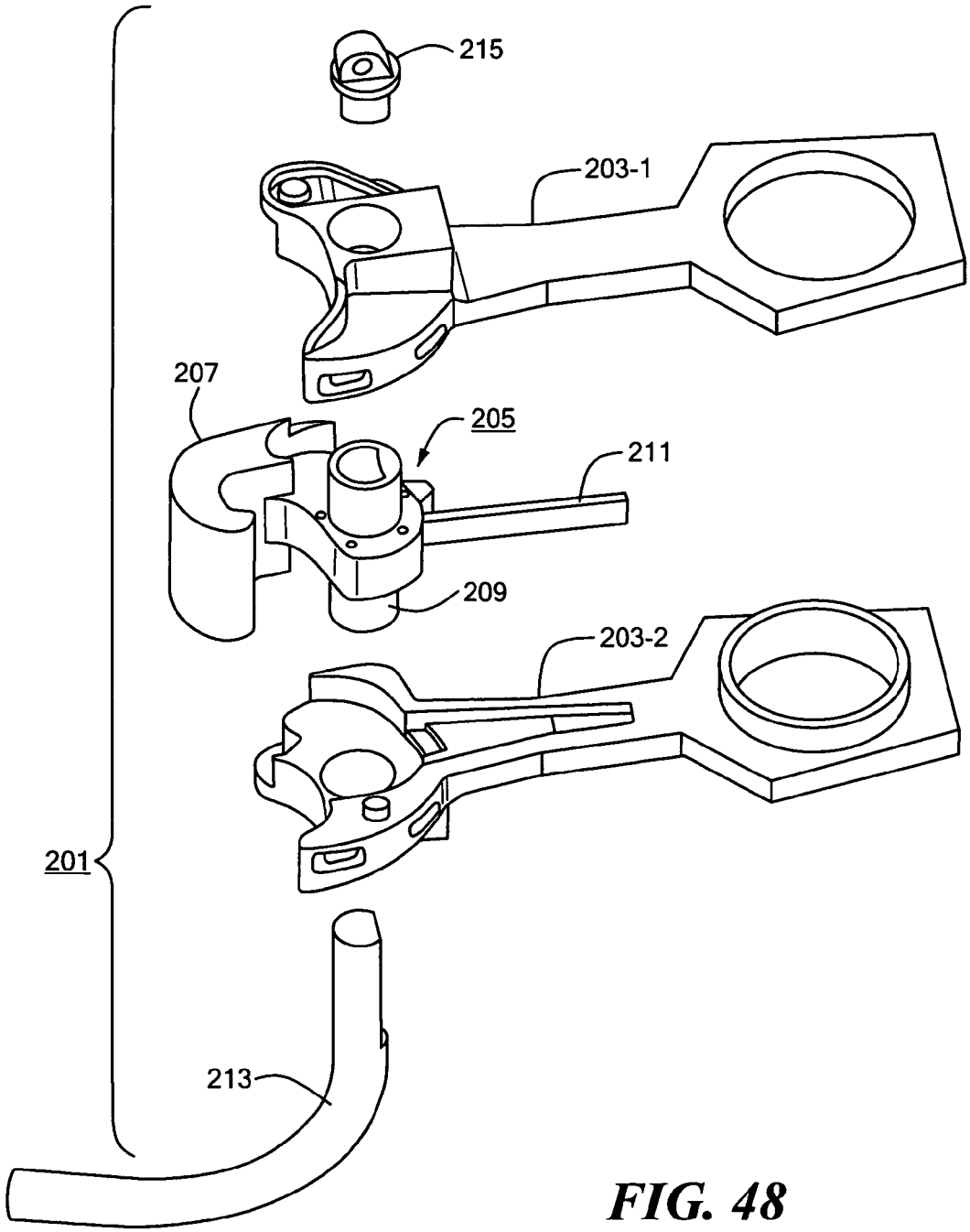
FIG. 48 is an exploded perspective view of the model railroad coupler shown in FIG. 47.
Figure 49:
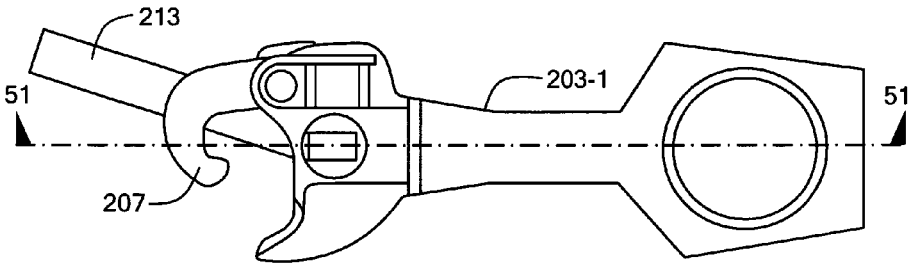
FIG. 49 is a top view of the model railroad coupler shown in FIG. 47.
Figure 50:
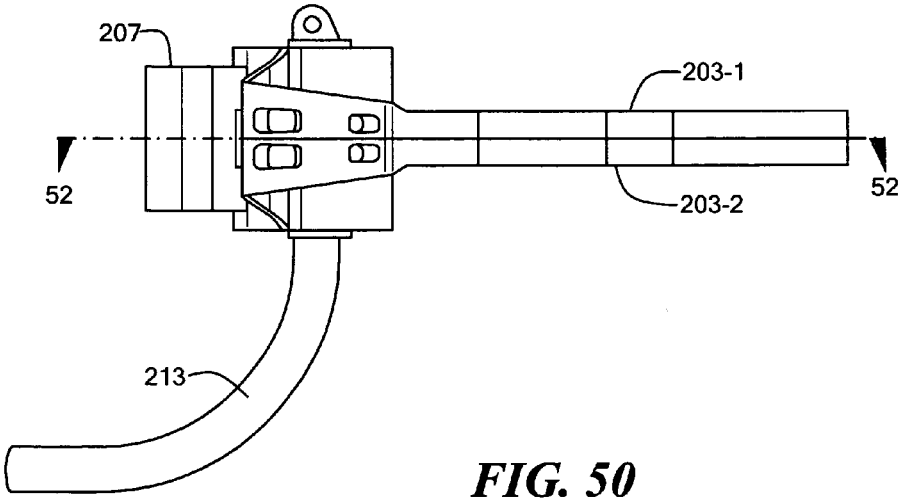
FIG. 50 is a side elevation of the model railroad coupler shown in FIG. 47.
Figure 51:
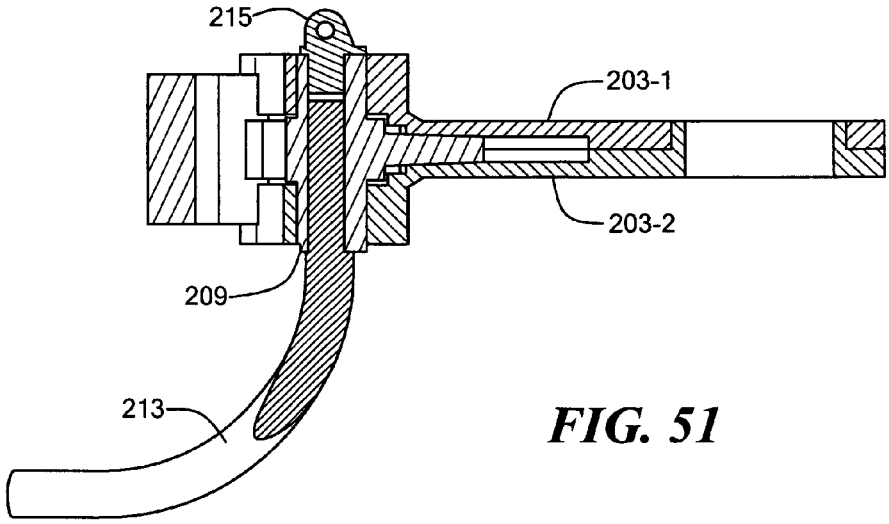
FIG. 51 is a section view taken along lines 51—51 in FIG. 49.
Figure 52:
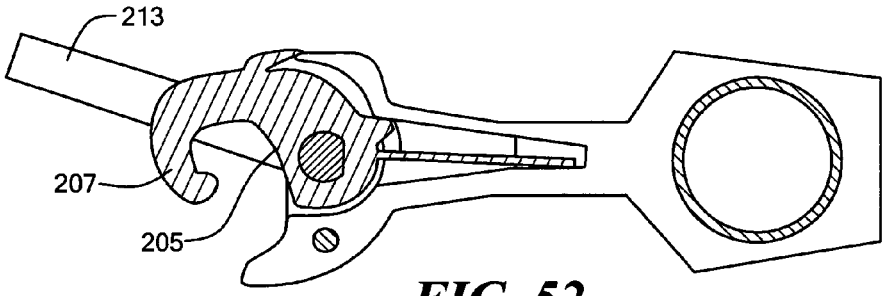
FIG. 52 is a section view taken along lines 52—52 in FIG. 50.
Figure 53:
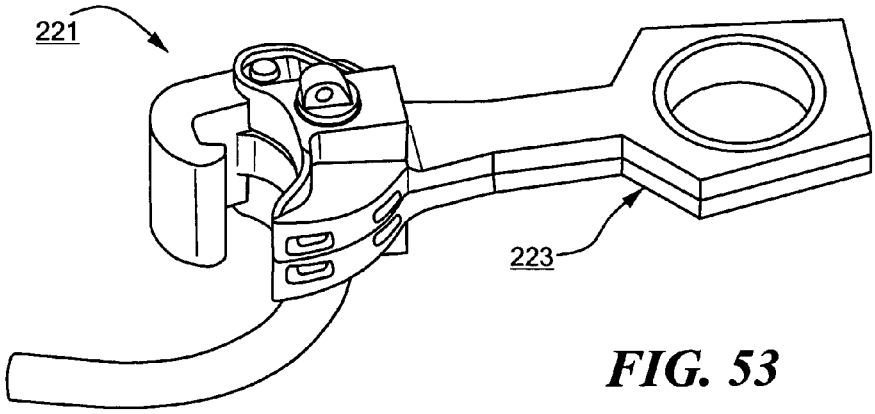
FIG. 53 is a perspective view taken from the top of another embodiment of a model railroad coupler constructed according to this invention.
Figure 54:
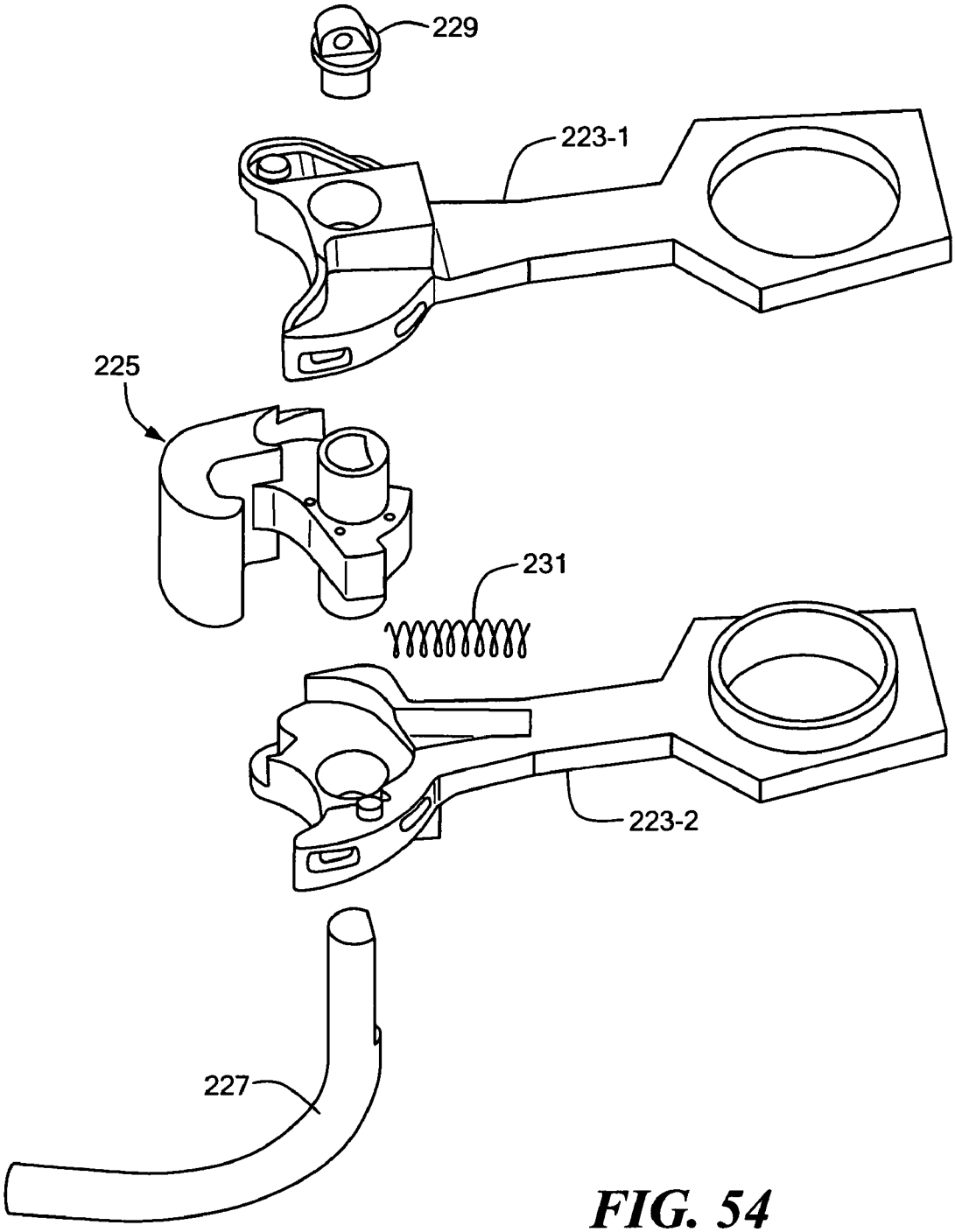
FIG. 54 is an exploded perspective view of the model railroad coupler shown in FIG. 53.
Figure 55:
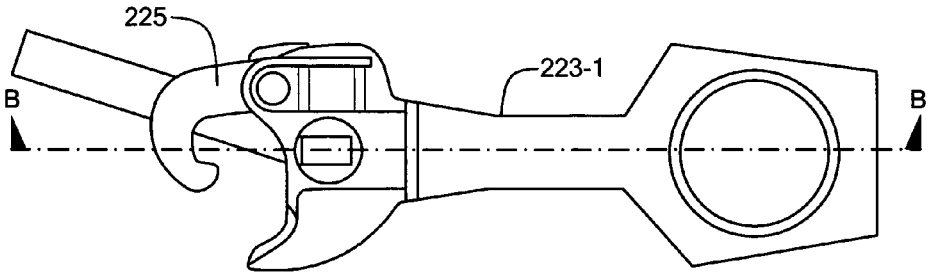
FIG. 55 is a top view of the model railroad coupler shown in FIG. 53.
Figure 56:
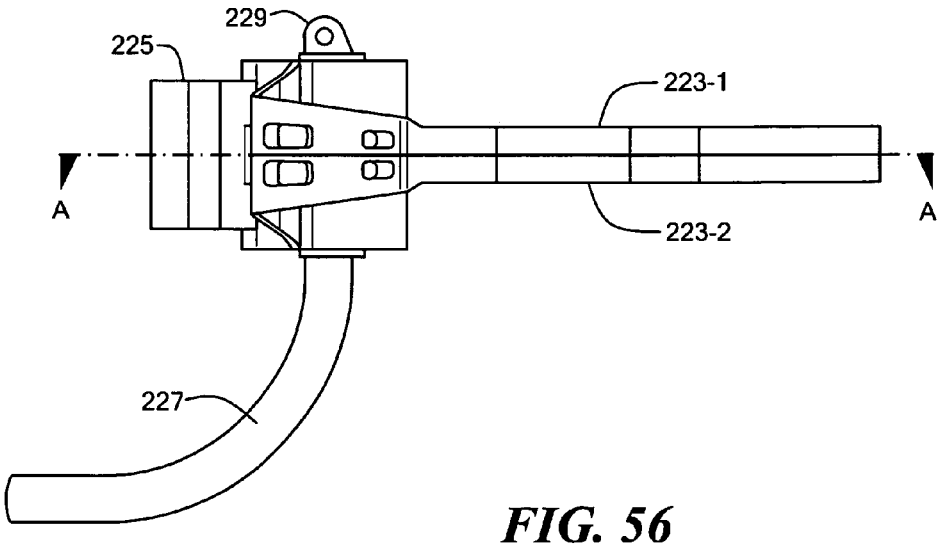
FIG. 56 is a side elevation of the model railroad coupler shown in FIG. 53.
Figure 57:
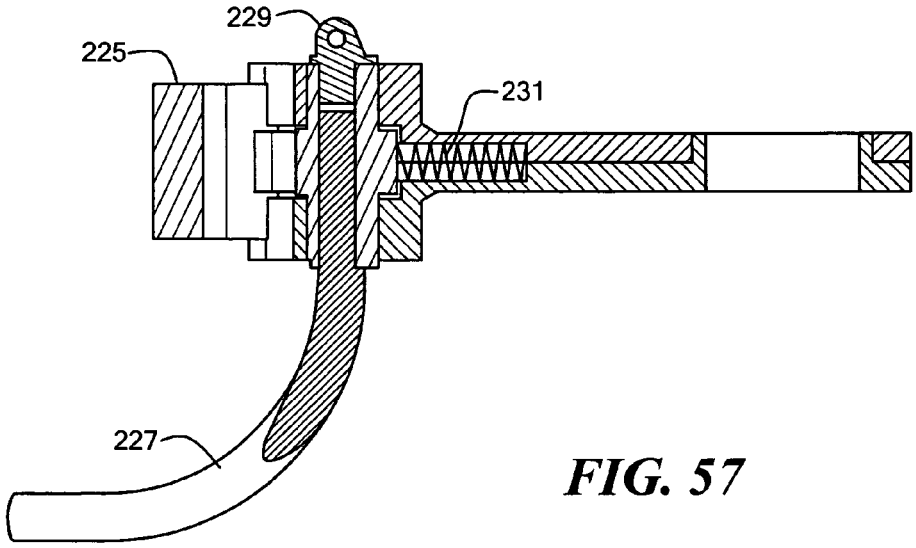
FIG. 57 is a section view taken along lines 57—57 in FIG. 55.
Figure 58:
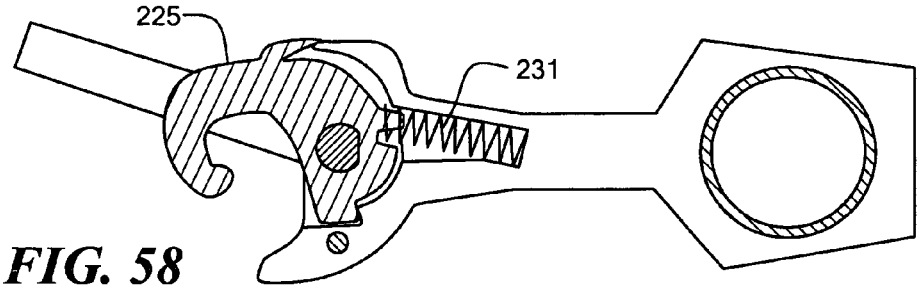
FIG. 58 is a section view taken along lines 58—58 in FIG. 56.
Figure 59:
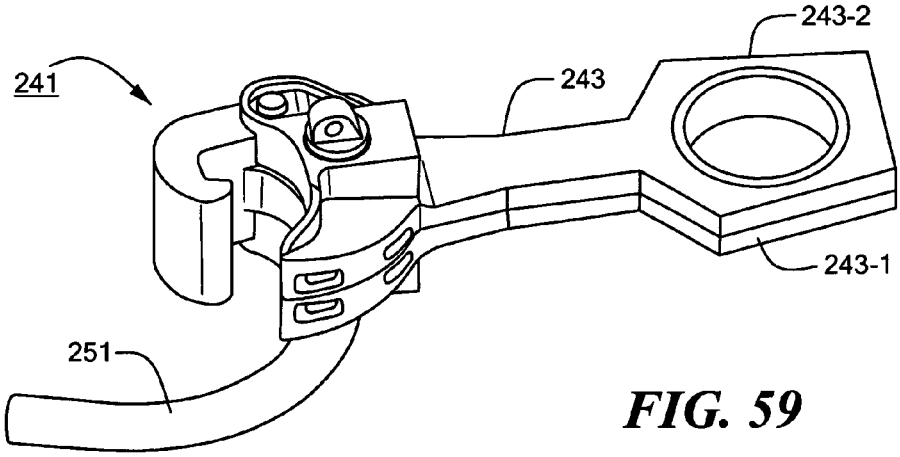
FIG. 59 is a perspective view taken from the top of another embodiment of a model railroad coupler constructed according to this invention.
Figure 60:
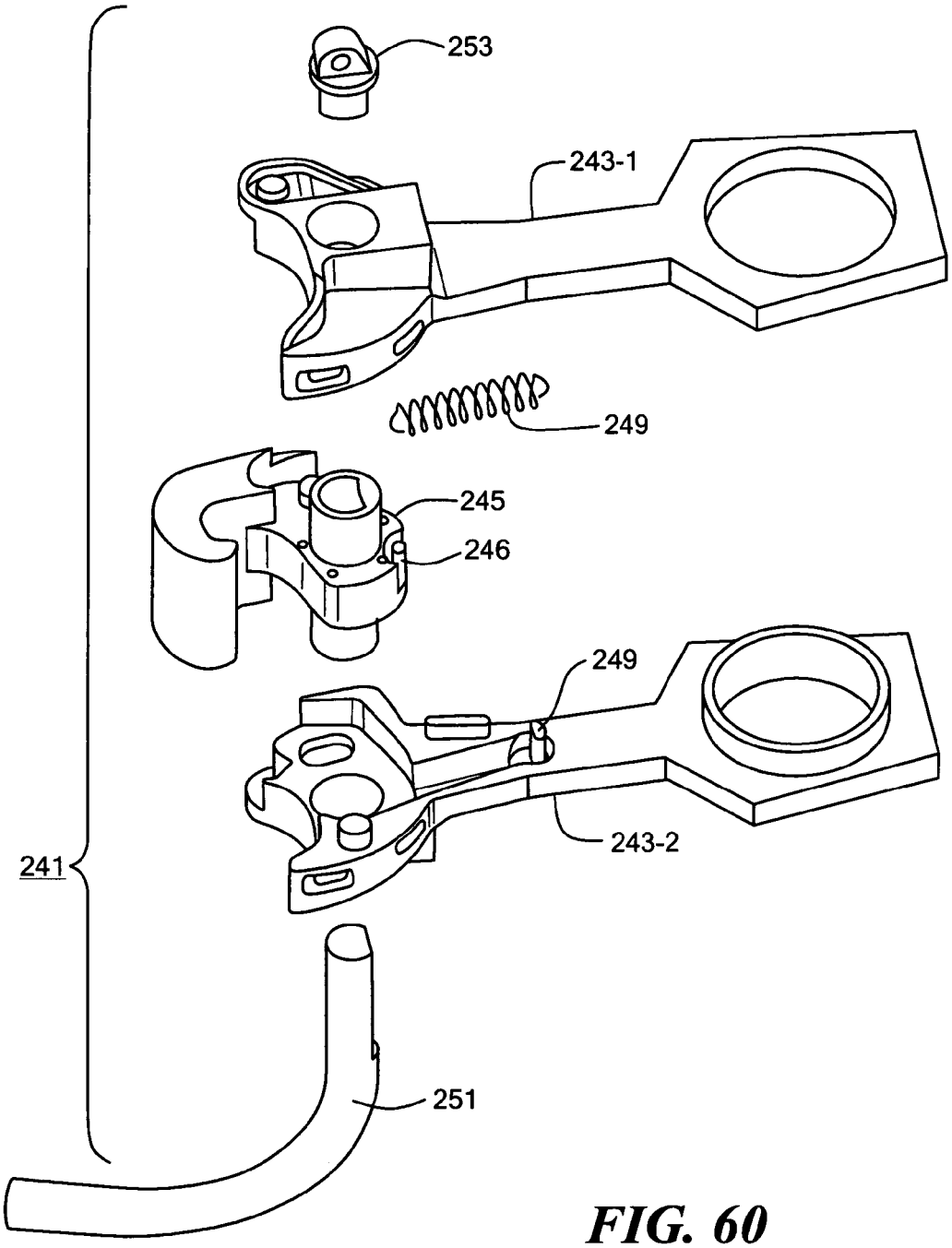
FIG. 60 is an exploded perspective view of the model railroad coupler shown in FIG. 59.
Figure 61:
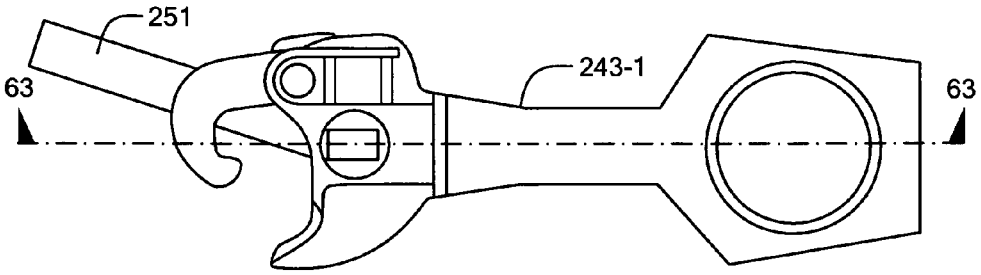
FIG. 61 is a ton view of the model railroad coupler shown in FIG. 59.
Figure 62:
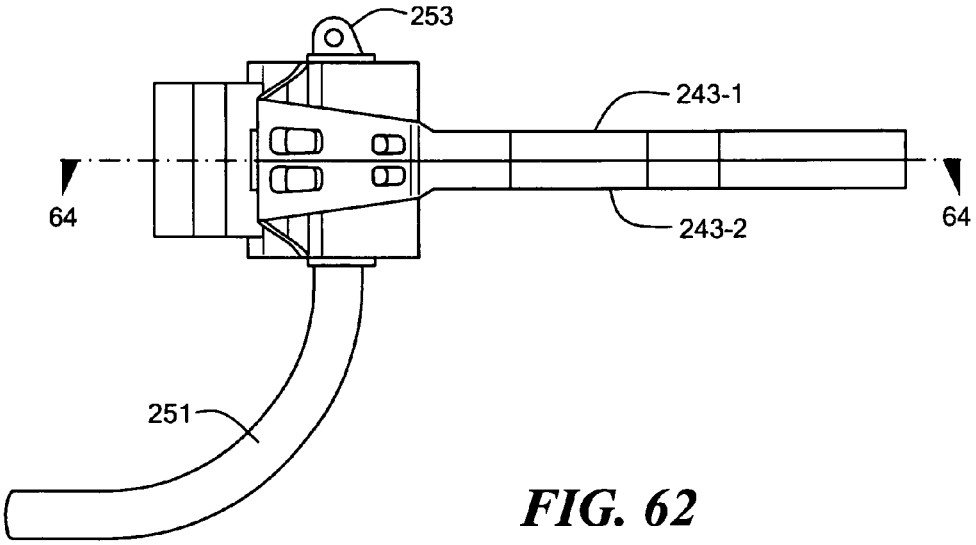
FIG. 62 is a side elevation of the model railroad coupler shown in FIG. 59.
Figure 63:
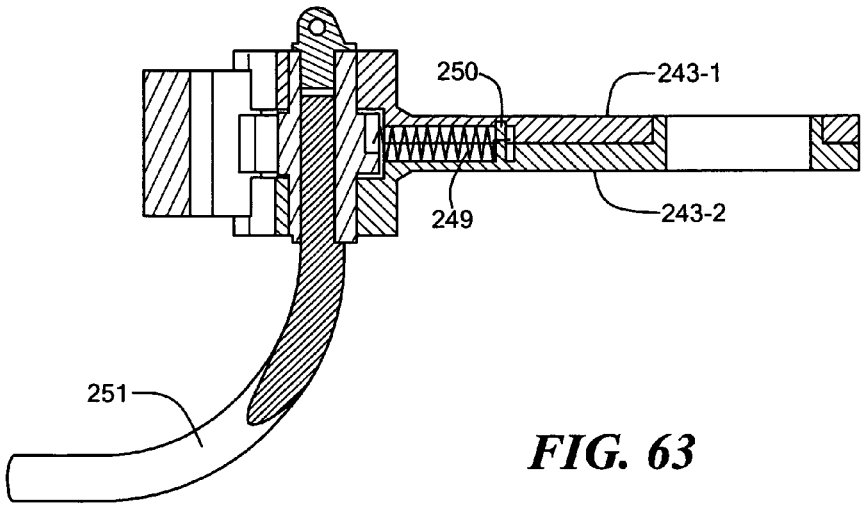
FIG. 63 is a section view taken along lines 63—63 in FIG. 62.
Figure 64:
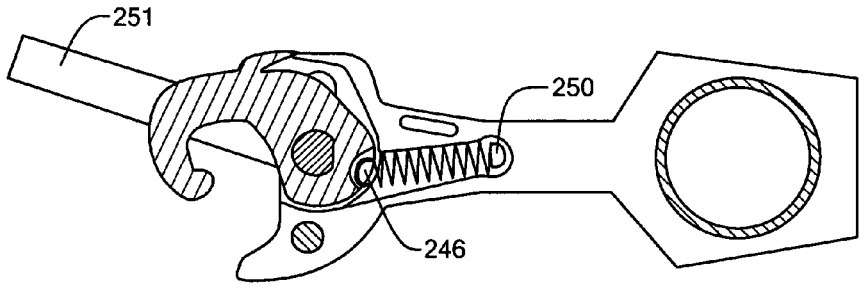
FIG. 64 is a section view taken along lines 63—63 in FIG. 62.

Referring now to FIGS. 8–10 there are shown top, side elevation and section views, respectively of two model railroad couplers of this invention coupled together.

Referring now to FIGS. 11 through 16, there is shown another embodiment of a model railroad coupler constructed according to this invention and identified by reference numeral 71.

Model railroad coupler 71 includes a shank 73, a knuckle 75, a leaf spring 77, a trip pin 79 and an end cap 81, as in model railroad coupler 11. Knuckle 75 and end cap 81 are identical in structure and function to knuckle 33 and end cap 39 in model railroad coupler 11.

Model railroad coupler 71 differs from model railroad coupler 11 in that leaf spring 77 is not a separate element as is the case with model railroad coupler 11, but rather is integrally formed with (i.e. is a part of) shank 73.

Shank 73, leaf spring 77 and end cap 81 are made of glass fiber filled liquid crystal polymer or other higher strength plastic matrices such as polyester or AVS. Knuckle 75 is made of carbon fiber filled liquid crystal polymer or other suitable plastic materials such as Teflon augmented plastic. Trip pin 79 is made of a ferrous material.

Model railroad coupler 71 is used in the same way as model railroad coupler 11.

Referring now to FIGS. 17 through 22, there is shown another embodiment of a model railroad coupler constructed according to this invention and identified by reference numeral 91.

Model railroad coupler 91 includes a shank 93, a knuckle 95, a leaf spring 97, a trip pin 99 and an end cap 100, as in model railroad coupler 11. Shank 93 and end cap 81 are identical in structure and function to shank 13 and end cap 39 in model railroad coupler 11.

Model railroad coupler 91 differs from model railroad coupler 11 in that leaf spring 97 is not a separate element as is the case with model railroad coupler 11, but rather is integrally formed with (i.e. is a part of) knuckle 95.

Shank 93, leaf spring 97 and end cap 100 are made of glass fiber filled liquid crystal polymer or other higher strength plastic matrices such as polyester or AVS. Knuckle 95 is made of carbon fiber filled liquid crystal polymer or other suitable plastic materials such as Teflon augmented plastic. Trip pin 99 is made of a ferrous material.

Model railroad coupler 91 is used in the same way as model railroad coupler 11.

Referring now to FIGS. 23 through 28, there is shown another embodiment of a model railroad coupler constructed according to this invention and identified by reference numeral 101.

Model railroad coupler 101, which operates in the same manner as model railroad coupler 11, includes a shank 103, identical to shank 13 a knuckle 105 mounted in shank 103, a spring 107 separate from shank 103 and knuckle 105 and disposed in a channel 109 in shank 103 for biasing knuckle 105 to pivot to a closed position, a trip pin 111 identical to trip pin 35 and an end cap 113 identical to end cap 39. The main differences between model railroad coupler 101 and model railroad coupler 11 are that spring 107 is a compression spring rather than a leaf spring and that the projection 115 on the rear of knuckle 105 for serving as a part of a stop is shaped so as to also hold in place the distal end 117 of spring 107.

Shank 103 and end cap 113 are made of glass fiber filled liquid crystal polymer or other higher strength plastic matrices such as polyester or AVS. Knuckle 105 is made of carbon fiber filled liquid crystal polymer or other suitable plastic materials such as Teflon augmented plastic. Trip pin 111 is made of a ferrous material. Spring 107 is made of a copper alloy which includes phosphorous (also known as phosphor bronze).

Referring now to FIGS. 29 through 34, there is shown another embodiment of a model railroad coupler constructed according to this invention and identified by reference numeral 121.

Model railroad coupler 121 which operates in the same manner as model railroad coupler 101, includes a shank 123, a knuckle 125 mounted in shank 123, a spring 127 separate from shank 123 and knuckle 125 and disposed in a channel 129 in shank 123 for bearing knuckle 125 to pivot to a closed position, a trip pin 131 identical to trip pin 111 and an end cap 133 identical to end cap 113. The main differences between model railroad coupler 121 and model railroad coupler 121 are that spring 127 is a tension spring rather than a compression spring, there is a post 135 on the rear end of knuckle on which is mounted the distal end 137 of spring 127, and the proximal end 139 of spring 127 is held in place by a retaining pin 141.

Shank 123 and end cap 133 are made of glass fiber filled liquid crystal polymer or other higher strength plastic matrices such as polyester or AVS. Knuckle 125 is made of carbon fiber filled liquid crystal polymer or other suitable plastic materials such as Teflon augmented plastic. Trip pin 131 is made of a ferrous material. Spring 107 is made of a copper alloy which includes phosphorous (also known as phosphor bronze).

Referring now to FIGS. 35 through 40, there is shown another embodiment of a model railroad coupler constructed according to this invention and identified generally by reference numeral 151.

Model railroad coupler 151 includes a shank 153, a knuckle 155, a leaf spring 157, a trip pin 159 and an end cap 161. Leaf spring 157 and end cap 161 are identical to leaf spring 37 and end cap 39, respectively, in model railroad coupler 11. Shank 153, knuckle 155, leaf spring 157, trip pin 159 and end cap 161 are made of the same material as the corresponding parts in model railroad coupler 11. The main differences between model railroad coupler 151 and model railroad coupler 11 are that shank 153 is a split shank made up of an upper shank member 153-1 and a lower shank member 153-2 rather than a one piece member 13 as in model railroad coupler 11 and that knuckle 155 is shaped to include a sleeve 163 in addition to a hook 165. Also trip pin 159 does not include an enlarged intermediate portion.

In assembling model railroad coupler 151, leaf spring 157 is placed in channel 167 in lower shank member 153-2. Then, knuckle 155 is placed on receiver 169 of head 171 of lower shank member 153-1 with sleeve 163 of knuckle 155 in bore 173. Then upper shank member 153-1 is placed on lower shank member 153-2 and the two shank members 153-1 and 153-2 fixed to each other by any suitable means such as ultrasonic welding. Then, trip pin 159 is pushed into sleeve 163 in knuckle 155.

Shank 153, leaf spring 157 and end cap 161 are made of glass fiber filled liquid crystal polymer or other higher strength plastic matrices such as polyester or AVS. Knuckle 155 is made of carbon fiber filled liquid crystal polymer or other suitable plastic materials such as Teflon augmented plastic.

Referring now to FIGS. 41 through 46, there is shown another embodiment of a model railroad coupler constructed according to this invention and identified by reference numeral 181.

Model railroad coupler 181 includes a split shank 183 made up of an upper shank member 183-1 and a lower shank member 183-2, a leaf spring 185 integrally formed onto lower shank member 183-2, a knuckle 187 shaped to include a hook 189 and an internally formed sleeve 191, a trip pin 193 and an end cap 195. Knuckle 187, trip pin 193 and end cap 195 are identical to knuckle 155, trip pin 159 and end cap 161 in model railroad coupler 151. Shank 183 and leaf spring 185 in model railroad coupler 181 differ from the shank 153 and leaf spring 157 in model railroad coupler 151 in that leaf spring 191 is internally formed onto lower shank member 183-2 rather than being separate form the shank member.

Shank 183, spring 183 and end cap 195 are made of glass fiber filled liquid crystal polymer or other higher strength plastic matrices such as polyester or AVS. Knuckle 187 is made of carbon fiber filled liquid crystal polymer or other suitable plastic materials such as Teflon augmented plastic. Trip pin 193 is made of a ferrous material.

Referring now to FIGS. 47 through 52, there is showing another embodiment of a model railroad coupler constructed according to this invention and identified by reference numeral 201. Model railroad coupler 201 differs from model railroad coupler 181 in that the leaf spring is integrally formed with the knuckle rather than the shank.

Thus, model railroad coupler 201 includes a split shank 203 made up of an upper shank member 203-1 and a lower shank member 203-2, a knuckle 205 having a hook 207, an integrally formed sleeve 209 and an integrally formed leaf spring 211, a trip pin 213 and an end cap 215.

Shank 203, spring 211 and end cap 215 are made of glass fiber filled liquid crystal polymer or other higher strength plastic matrices such as polyester or AVS. Knuckle 205 is made of carbon fiber filled liquid crystal polymer or other suitable plastic materials such as Teflon augmented plastic. Trip pin 213 is made of a ferrous material.

Referring now to FIGS. 53–58, there is shown another embodiment of a model railroad couples constructed according to this invention and identified by reference numeral 221. Model r4ailroad coupler 221 differs from model railroad coupler 151 in that the spring member is a compression spring rather than a leaf spring and that the knuckle is provided with a projection similar to projection 115 in knuckle 105 in model railroad coupler 101 for holding the spring in place.

Thus, model railroad coupler 221 includes a split shank 223 identical to shank 153 and made up of an upper shank member 223-1 and a lower shank member 223-2, a knuckle 225 identical to knuckle 105 in model railroad coupler 101, a trip pin 227 identical to trip pin 159 in model railroad coupler 151, an end cap 229 identical to end cap 161 in model railroad coupler 151 and a compression spring 231 identical to compression spring 107 in model railroad coupler 101.

Shank 223, and end cap 229 are made of glass fiber filled liquid crystal polymer or other higher strength plastic matrices such as polyester or AVS. Knuckle 225 is made of carbon fiber filled liquid crystal polymer or other suitable plastic materials such as Teflon augmented plastic. Trip pin 227 is made of a ferrous material. Spring 238 is made of a copper alloy which includes phosphorous.

Referring now to FIGS. 59–63 there is shown another embodiment of a model railroad coupler constructed according to this invention and identified by reference numeral 241.

Model railroad coupler 241 differs from model railroad coupler 221 mainly in that the spring member for biasing the knuckle to a closed position is a tension spring rather than a compression spring and that the knuckle and shank are constructed to hold the spring in place.

Thus, model railroad coupler 241 includes a split shank 243 having an upper shank member 243-1 and a lower shank member 243-2, a knuckle 245 identical to knuckle 125 in model railroad coupler 121, a tension spring 249 identical to tension spring 127, knuckle 245 including a post 246 for holding the distal unit of tension spring 127 in place, a post 250 in lower shank member 243-2 for holding in place the proximal end of spring 249, a trip pin 251 identical to trip pin 227 and an end cap 253 identical to end cap 229. Shank 243, spring 249 and end cap 253 are made of glass fiber filled liquid crystal polymer or other higher strength plastic matrices such as polyester or AVS. Knuckle 245 is made of carbon fiber filled liquid crystal polymer or other suitable plastic materials such as Teflon augmented plastic. Trip pin 251 is made of a ferrous material. Spring 249 is made of a copper alloy which includes phosphorous.

The various parts of the model railroad coupler of this invention other than the springs may be made by injection molding, die-casting, an SLA process, lost wax casting or any other similar technique. Also, the leaf spring may be made by injection molding.

The embodiments of the present invention recited herein are intended to be merely exemplary and those skilled in the art will be able to make numerous variations and modifications to it without departing from the sprit of the present invention. All such variations and modifications are intended to be within the scope of the present invention as defined by the claims appended hereto.

What is claimed is:

1. A model railroad coupler comprising:

(a) a shank having a proximal end and a distal end, the proximal end being shaped to define a joining element for attaching the model railroad coupler to a unit of model railroad rolling stock, the distal end being shaped to define a head, (b) a knuckle mounted on the head for limited rotational movement between a closed position and an open position, the knuckle having a hook, (c) a spring disposed inside the shank and between the joining element and the head for providing a force to the knuckle to bias the knuckle to pivot into the closed position, and (d) a trip pin mounted on the knuckle for rotating the knuckle from the closed position to the open position.

2. The model railroad coupler of claim 1 wherein the shank is a unitary one piece elongated member.

3. The model railroad coupler of claim 2 wherein the spring is a compression spring.

4. The model railroad coupler of claim 2 wherein the spring is a tension spring.

5. The model railroad coupler of claim 1 wherein the shank is made up of two pieces.

6. The model railroad coupler of claim 5 wherein the two pieces comprises an upper member and a lower member.

7. The model railroad coupler of claim 6 wherein the spring is a tension spring.

8. The model railroad coupler of claim 6 wherein the spring is a compression spring.

9. The model railroad coupler of claim 1 wherein the shank is made of glass fiber filled liquid crystal polymer.

10. The model railroad coupler of claim 1 wherein the knuckle is made of carbon fiber filled liquid crystal polymer.

11. The model railroad coupler of claim 1 wherein the trip pin is made at least partly of magnetic material.

12. The model railroad coupler of claim 1 wherein the head of the shank has a knuckle received and the knuckle is mounted on the head in the knuckle receiver.

13. The model railroad coupler of claim 1 wherein the head includes a stop for limiting rotational movement of the knuckle in one direction.

14. The model railroad coupler of claim 1 wherein the joining element in the shank is in the form of a circular opening for attaching the model railroad coupler to a model railroad rolling stock.

15. A model railroad coupler comprising:

(a) a shank having a proximal end and a distal end, the proximal end being shaped to define a joining element for attaching the model railroad coupler to a unit of model railroad rolling stock, the distal end being shaped to define a head, (b) a knuckle mounted on the head for limited rotational movement between a closed position and an open position, the knuckle having a hook, (c) a trip pin mounted on the knuckle for rotably fixing the knuckle within the head of the shank and, when urged to do so, for rotating the knuckle from the closed position to the open position, and (d) a spring disposed inside the shank and between the joining element and the head for providing a force to the knuckle to bias the knuckle to pivot into the closed position.

16. The model railroad coupler of claim 15 wherein the shank is made up of two pieces and the knuckle includes a sleeve for rotably fixing the knuckle within the shaft.

17. The model railroad coupler of claim 16 wherein the two pieces comprises an upper member and a lower member.

18. The model railroad coupler of claim 17 wherein the spring is a leaf spring.

19. The model railroad coupler of claim 18 wherein the leaf spring is a member separate from the knuckle and from the shank.

20. The model railroad coupler of claim 19 wherein the leaf spring is integrally formed with the knuckle.

21. The model railroad coupler of claim 18 wherein the leaf spring is integrally formed with the shank.

22. The model railroad coupler of claim 15 wherein the spring is a tension spring.

23. The model railroad coupler of claim 15 wherein the spring is a compression spring.

24. A model railroad coupler comprising:

(a) a shank having a proximal end and a distal end, the proximal end being shaped to define a joining element for attaching the model railroad coupler to a unit of model railroad rolling stock, the distal end being shaped to define a head, (b) a knuckle mounted on the head for limited rotational movement between a closed position and an open position, the knuckle having a hook, (c) a spring disposed inside the shank for providing a force to the knuckle to bias the knuckle to pivot into the closed position, and (d) a trip pin mounted on the knuckle for rotating the knuckle from the closed position to the open position, (e) wherein the shank is a one piece elongated member and wherein the spring is a leaf spring.

25. The model railroad coupler of claim 24 wherein the leaf spring is a member separate from the knuckle and from the shank.

26. The model railroad coupler of claim 24 wherein the leaf spring is integrally formed with the knuckle.

27. The model railroad coupler of claim 24 wherein the leaf spring is integrally formed with the shank.

28. A model railroad coupler comprising:

(a) a shank having a proximal end and a distal end, the proximal end being shaped to define a joining element for attaching the model railroad coupler to a unit of model railroad rolling stock, the distal end being shaped to define a head, (b) a knuckle mounted on the head for limited rotational movement between a closed position and an open position, the knuckle having a hook, (c) a spring disposed inside the shank for providing a force to the knuckle to bias the knuckle to pivot into the closed position, and (d) a trip pin mounted on the knuckle for rotating the knuckle from the closed position to the open position, (e) wherein the shank is made up of two pieces, (f) wherein the two pieces comprise an upper member and a lower member, and (g) wherein the spring is a leaf spring.

29. The model railroad coupler of claim 28 wherein the leaf spring is a member separate from the knuckle and from the shank.

30. The model railroad coupler of claim 28 wherein the leaf spring is integrally formed with the knuckle.

31. The model railroad coupler of claim 28 wherein the leaf spring is integrally formed with the shank.

* * * * *